US007697377B2

(12) United States Patent
Agesawa et al.

(10) Patent No.: US 7,697,377 B2
(45) Date of Patent: Apr. 13, 2010

(54) PORTABLE TIMEPIECE AND ELECTRONIC APPARATUS

(75) Inventors: Kazunari Agesawa, Matsumoto (JP); Kiyoto Takeda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 348 days.

(21) Appl. No.: 11/490,084

(22) Filed: Jul. 21, 2006

(65) Prior Publication Data

US 2007/0025187 A1 Feb. 1, 2007

(30) Foreign Application Priority Data

Jul. 21, 2005 (JP) ..... 2005-211846
Jul. 21, 2005 (JP) ..... 2005-211940
Jun. 30, 2006 (JP) ..... 2006-182360
Jun. 30, 2006 (JP) ..... 2006-182518

(51) Int. Cl.
*G04F 5/00* (2006.01)

(52) U.S. Cl. ..... 368/156

(58) Field of Classification Search ..... 368/155, 368/156, 200, 202; 331/3, 94.1, 250, 251
See application file for complete search history.

(56) References Cited

U.S. PATENT DOCUMENTS 4,322,833 A * 3/1982 Husted ..... 368/69
4,943,955 A * 7/1990 Rabian et al. ..... 368/155
5,168,478 A 12/1992 Baker
6,265,945 B1 7/2001 Delaney et al.
6,630,872 B1 * 10/2003 Lanoue et al. ..... 331/176
6,806,784 B2 10/2004 Hollberg et al.
2004/0017131 A1 1/2004 Sawada et al.
2005/0007887 A1 * 1/2005 Sorrells et al. ..... 368/107
2005/0020302 A1 * 1/2005 Ikeda et al. ..... 455/556.1

(Continued)

FOREIGN PATENT DOCUMENTS

JP S58-038882 A 3/1983

(Continued)

OTHER PUBLICATIONS

Robert Wynands; "The atomic wrist-watch"; news and views; Nature vol. 429; Jun. 3, 2004; XP-002505655; Nature Publishing Group; www.nature.com/nature.

(Continued)

*Primary Examiner*—Edwin A. Leon
(74) *Attorney, Agent, or Firm*—Global IP Counselors, LLP

(57) ABSTRACT

A timepiece comprises an atomic oscillator for generating and outputting a reference clock signal, and a timepiece module that operates based on the reference clock signal, wherein the atomic oscillator and the timepiece module are disposed separately so as to be thermally separated. The timepiece also comprises a crystal oscillator for generating and outputting a first oscillation signal, an atomic oscillator for generating and outputting a second oscillation signal with a higher precision than the first oscillation signal, a timepiece module that operates based on the first oscillation signal and the second oscillation signal, and a thermal separator for thermally separating the atomic oscillator from the crystal oscillator and the timepiece module. A portable timepiece and electronic device can thereby be configured so that the effects of heat generation can be reduced and power consumption can be reduced even in cases in which the atomic oscillator is used as a reference oscillator.

25 Claims, 15 Drawing Sheets

U.S. PATENT DOCUMENTS

| | | | | |
|---|---|---|---|---|
| 2005/0128014 | A1* | 6/2005 | Matsuura et al. | 331/86 |
| 2006/0022319 | A1* | 2/2006 | Matsuzawa et al. | 257/678 |
| 2007/0236301 | A1* | 10/2007 | Mayder | 331/158 |
| 2007/0278976 | A1* | 12/2007 | Kawaguchi et al. | 318/116 |

FOREIGN PATENT DOCUMENTS

| | | | |
|---|---|---|---|
| JP | S58-72689 | U | 5/1983 |
| JP | S60-4980 | U | 1/1985 |
| JP | H02-9894 | U | 1/1990 |
| JP | H02-41194 | U | 3/1990 |
| JP | H05-300016 | A | 11/1993 |
| JP | H06-31731 | B | 4/1994 |
| JP | 3038579 | U | 4/1997 |
| JP | H09-197064 | A | 7/1997 |
| JP | H11-249754 | A | 9/1999 |
| JP | 2000-004095 | A | 1/2000 |
| JP | 2000-315121 | A | 11/2000 |
| JP | 2003-242727 | A | 8/2003 |
| WO | WO 97/12298 | A1 | 4/1997 |

OTHER PUBLICATIONS

John Kitching; "An Atomic Clock on a Chip"; Horological Journal; Feb. 2005, XP-002505656.

* cited by examiner

13

PORTABLE TIMEPIECE AND ELECTRONIC APPARATUS

CROSS-REFERENCE TO RELEVANT APPLICATIONS

This specification claims priority from Japanese Patent Application Nos. 2005-211846, 2005-211940, 2006-182360, and 2006-182518, and hereby incorporates by reference Japanese Patent Application Nos. 2005-211846, 2005-211940, 2006-182360, and 2006-182518 in their entirety.

BACKGROUND OF THE INVENTION

1. Technological Field of the Invention

The present invention relates to a portable timepiece and an electronic device that can be worn while walking, and particularly relates to a wristwatch and electronic device provided with an atomic oscillator for generating a reference clock signal.

2. Description of Relevant Technology

In some electronic timepieces, which are electronic devices, a reference clock signal outputted from a reference oscillator is divided to generate, for example, a 1-Hz signal, and time is measured based on the 1-Hz signal. One known example of this type of electronic timepiece is a VHP (very-high-precision) timepiece that achieves an accuracy that is within plus or minus several tens of seconds per year by using a temperature-compensated crystal oscillator as the reference oscillator (Japanese Examined Patent Application (Kokoku) No. 6-31731, for example).

In recent years, standard oscillators that use an atomic oscillator have been proposed (U.S. Pat. Nos. 6,806,784 and 6,265,945, for example).

However, when the same configuration as a timepiece that uses a conventional crystal oscillator is used in cases in which an atomic oscillator is used as the reference oscillator of an electronic timepiece, problems occur in that the heat from the atomic oscillator (for example, the heat from a heater resulting from maintaining the temperature of the cells, the heat generated by a laser diode, or the like; about 85° C.) causes the material of the gear train mechanism and other driven objects, the lubricating oil for allowing these objects to be driven smoothly, the power-supplying battery, and the like to be adversely affected by the increase in temperature.

Specifically, the elements (lubricating oil, oscillating circuit, drive circuit, battery, and the like) constituting the driven objects of the timepiece (the movement) are more likely to undergo deformation, degradation, a change in characteristics, and other undesirable changes.

Also, problems occur in that power loss increases along with heat generation, and power consumption increases as a result.

SUMMARY OF THE INVENTION

In view of this, an object of the present invention is to provide a portable timepiece or electronic device, and particularly a portable timepiece configured as a wristwatch, wherein the effects of heat can be reduced and power consumption can be reduced in cases in which an atomic oscillator is used as the reference oscillator.

In order to solve the above-described problems, there is provided a portable timepiece comprising an atomic oscillator for generating and outputting a reference clock signal, a timepiece module that operates based on the reference clock signal, and a thermal separator for thermally separating the atomic oscillator and the timepiece module.

In accordance with this configuration, since the atomic oscillator and the timepiece module are thermally separated by the thermal separator, the timepiece module is not affected by the heat of the atomic oscillator even in a relatively small portable timepiece, and reduction of mechanical component precision, degradation of the lubricating oil, and the like can be suppressed.

In this case, it is preferable that the timepiece comprise a case, wherein the atomic oscillator is disposed in the case, and either an air layer or a thermally insulating material is disposed between the atomic oscillator and the timepiece module as the thermal separator.

It is also preferable that the atomic oscillator be placed in a position relative to the timepiece module, and be integrated with the timepiece module.

It is also preferable that the case have a module-accommodating part for accommodating the timepiece module, and that the atomic oscillator be disposed around the periphery of the module-accommodating part.

It is also preferable that the timepiece have a casing frame that is disposed within the case, that supports the timepiece module, and that is formed from a thermally insulating material that functions as the thermal separator, wherein the module-accommodating part accommodates the timepiece module supported by the casing frame.

It is also preferable that the atomic oscillator and the timepiece module be disposed so as to be separated in three dimensions.

It is also preferable that the timepiece module and the atomic oscillator be disposed so that orthogonal projections of the timepiece module and the atomic oscillator onto a specific plane do not overlap.

It is also preferable that the case comprise a case back, and the atomic oscillator be supported on the case back.

It is also preferable that the portable timepiece be configured as a wristwatch that comprises a timepiece band for mounting the portable timepiece on the arm.

It is also preferable that the atomic oscillator is supported in the timepiece band.

It is also preferable that the timepiece comprise a dial for displaying the time, wherein the atomic oscillator is supported in the dial.

It is also preferable that the atomic oscillator comprise a cell in which atoms are sealed; a heater for heating the cell; and a control device in which the point of reference is a frequency that is equivalent to the energy difference between the energy level of the ground state and the energy level of the excited state that accompanies excitation of the atoms in the cell, and which controls the heater and maintains the cell at a specific temperature.

It is also preferable in these configurations that the material of the signal wiring that electrically connects the atomic oscillator with the timepiece module have a heat resistance value needed to adequately inhibit heat transfer from the atomic oscillator to the timepiece module.

There is also provided an electronic device comprising an atomic oscillator for generating and outputting a reference clock signal, an operating module that operates based on the reference clock signal, and a thermal separator for thermally separating the atomic oscillator and the operating module.

In accordance with this configuration, since the atomic oscillator and the operating module are thermally separated by the thermal separator, the operating module is not affected by the heat of the atomic oscillator even in a relatively small electronic device, and reduction of mechanical component precision, degradation of the lubricating oil, and the like can be suppressed.

In this case, it is preferable that the timepiece comprise a case, wherein the atomic oscillator is disposed in the case, and either an air layer or a thermally insulating material is disposed between the atomic oscillator and the operating module as the thermal separator.

Further provided is an electronic device comprising a crystal oscillator for generating and outputting a first oscillation signal, an atomic oscillator for generating and outputting a second oscillation signal with a higher precision than the first oscillation signal, an operating module that operates based on the first oscillation signal and the second oscillation signal, and a thermal separator for thermally separating the atomic oscillator from the crystal oscillator and the operating module.

In accordance with this configuration, since the atomic oscillator is thermally separated from the crystal oscillator and the operating module by the thermal separator, the crystal oscillator and the operating module are not susceptible to the effects of the heat generated by the atomic oscillator, and a normal state of operation can be maintained over long periods of time.

In this case, it is preferable that the crystal oscillator and the operating module be disposed integrally with each other.

It is also preferable that the atomic oscillator be disposed integrally with the operating module.

It is also preferable that the thermal separator include either an air layer or a thermally insulating material.

It is also preferable that the electronic device comprise a case having a module-accommodating part for accommodating the operating module, wherein the atomic oscillator is disposed around the periphery of the module-accommodating part of the case.

It is also preferable that the electronic device have a casing frame formed from a thermally insulating material that supports the operating module, wherein the module-accommodating part accommodates the operating module supported by the casing frame.

It is also preferable that the atomic oscillator and the operating module be disposed so as to be separated in three dimensions.

It is also preferable that the operating module and the atomic oscillator be disposed so that orthogonal projections of the operating module and the atomic oscillator onto a specific plane do not overlap.

It is also preferable that the electronic device constitute a timekeeping device, and the operating module include a timepiece drive circuit.

It is also preferable that the electronic device be configured as a wristwatch, that the electronic device comprise a timepiece band for mounting the wristwatch on the body, and that the atomic oscillator be supported in the timepiece band.

It is also preferable that the electronic device be configured as a wristwatch, and the electronic device be supported in a timepiece band for mounting the wristwatch on the body.

It is also preferable that the electronic device comprise a dial for displaying the time, wherein the atomic oscillator is supported in the dial.

It is also preferable that the atomic oscillator comprise a cell in which atoms are sealed; a heater for heating the cell; and a control device in which the point of reference is a frequency that is equivalent to the energy difference between the energy level of the ground state and the energy level of the excited state that accompanies excitation of the atoms in the cell, and which controls the heater and maintains the cell at a specific temperature.

The objectives, characteristics, merits, and other attributes of the present invention described above shall be clear to those skilled in the art from the description of the invention hereinbelow. The description of the invention and the accompanying diagrams disclose the preferred embodiments of the present invention.

DESCRIPTION OF THE PREFERRED EMBODIMENTS

Preferred embodiments of the present invention are described below with reference to the diagrams.

[1] Embodiment 1

Figure 1:
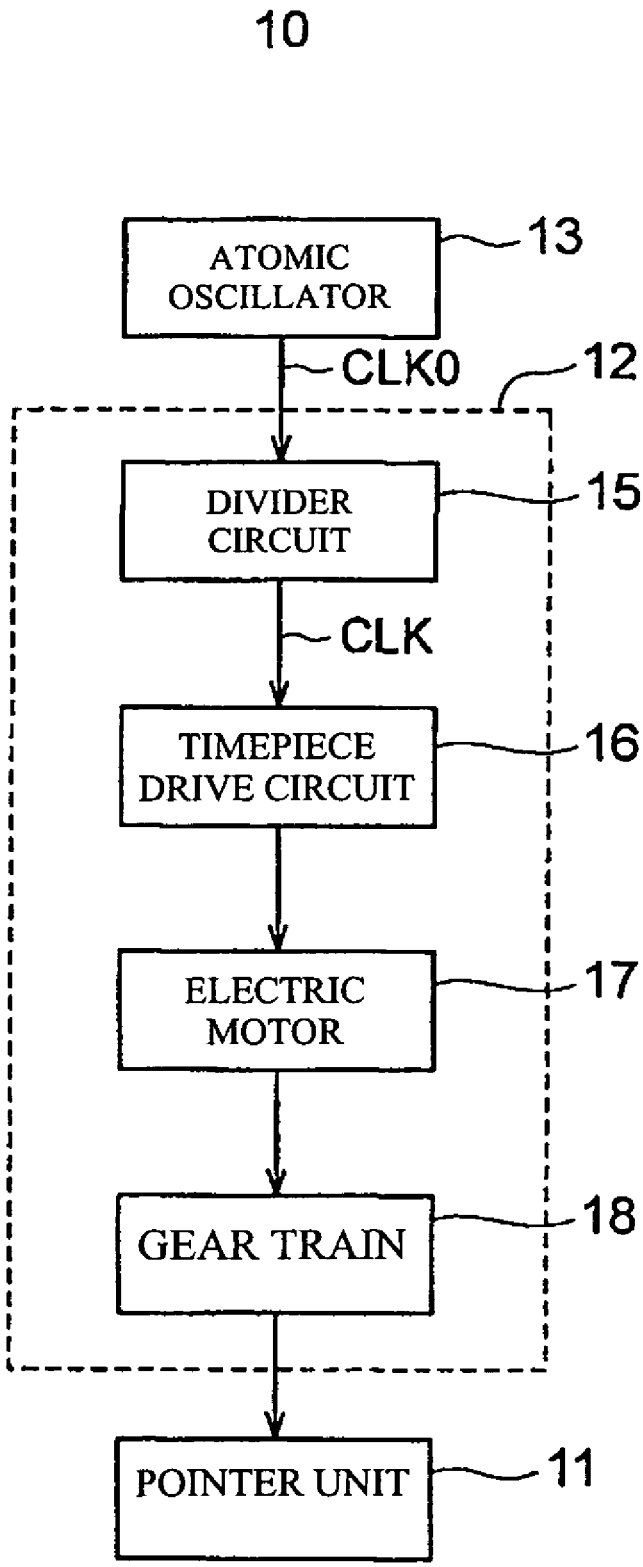
FIG. 1 is a block diagram showing the schematic configuration of a timepiece of an embodiment.

FIG. 1 is a block diagram showing the schematic configuration of a timepiece of the embodiment.

Broadly classified, a wristwatch (electronic timepiece) 10 as a portable timepiece comprises a pointer unit 11 that has pointers for displaying the time, a timepiece module 12 as an operating module that drives the pointer unit 11 on the basis of a reference clock signal CLK0, and an atomic oscillator 13 for generating and outputting a reference clock signal CLK0.

In this case, the timepiece module 12 and the atomic oscillator 13 are disposed so as to be separated in three dimensions; i.e., the components are disposed so that the orthogonal projections of the timepiece module 12 and the atomic oscillator 13 onto a specific plane (a plane parallel to the front surfaces) do not overlap.

Furthermore, the timepiece module 12 comprises a divider circuit 15 for dividing the reference clock signal CLK0, and generating and outputting an operating clock signal CLK; a timepiece drive circuit 16 for driving a timepiece mechanism on the basis of the operating clock signal CLK, an electric motor 17 that constitutes the timepiece mechanism and that is controlled by the timepiece drive circuit 16, and a gear train 18 for transmitting the drive force of the electric motor 17.

In the divider circuit 15, dividers that include a data-setting ½ divider circuit for setting a logic rate are connected in several stages, the reference clock signal CLK0 is divided up to 1 Hz, and a 1-Hz operating clock signal CLK is output.

Figure 2A:
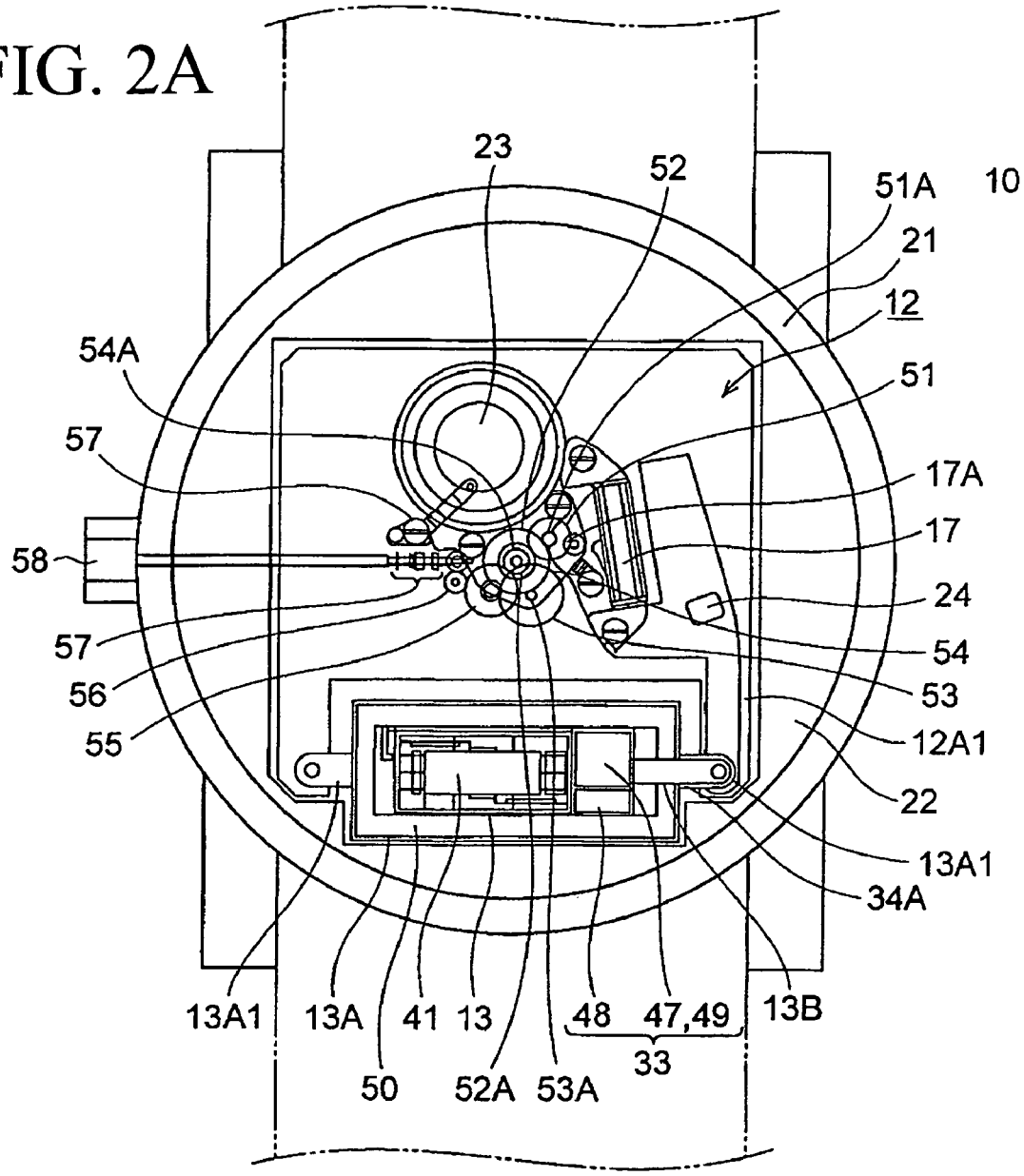
FIG. 2A is a diagram showing the manner in which the components are mounted when the timepiece of the first embodiment is viewed from the front.
Figure 2B:
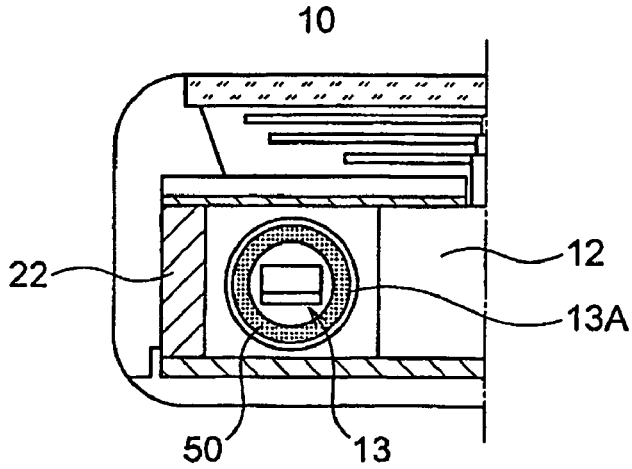
FIG. 2B is a partial cross-sectional view of the timepiece of the first embodiment.

FIGS. 2A and 2B are diagrams showing the manner in which the components are mounted in the timepiece of the first embodiment. FIG. 2A is a diagram showing the manner in which the components are mounted when the timepiece of the first embodiment is viewed from the front. FIG. 2B is a partial cross-sectional view of the timepiece of the first embodiment.

Figure 3:
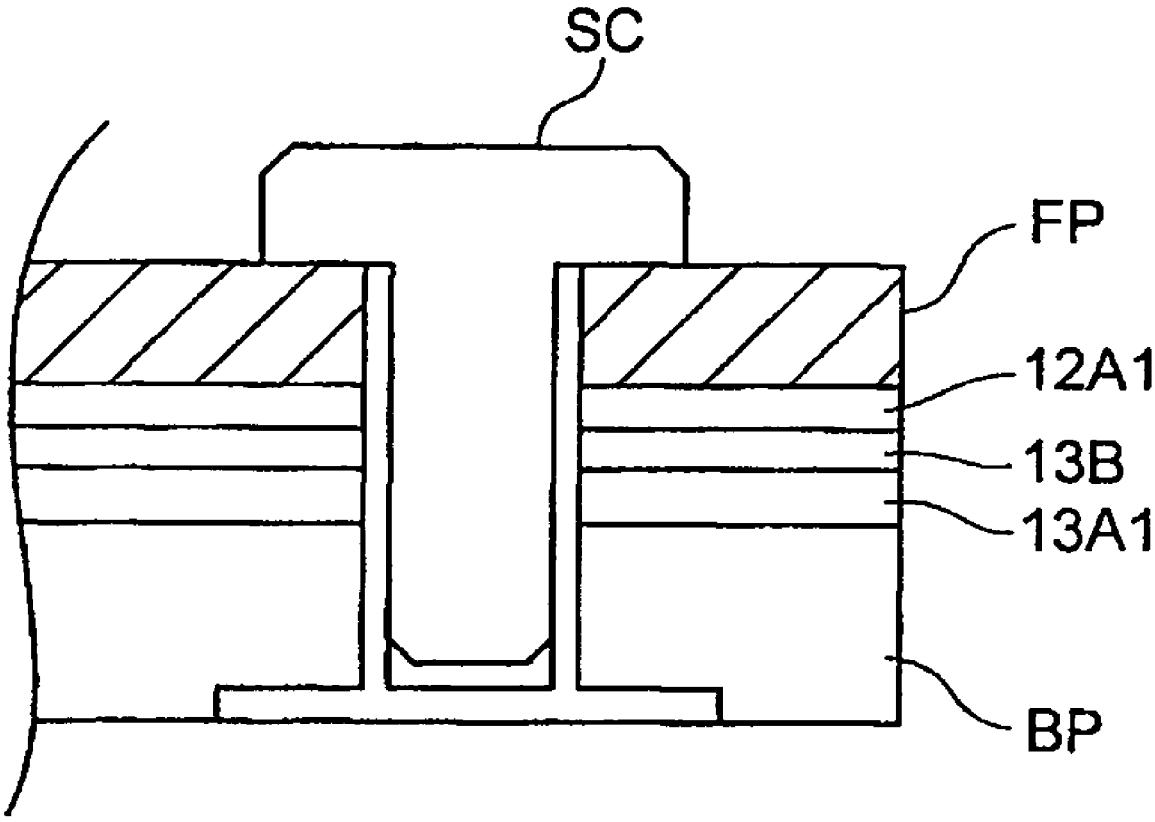
FIG. 3 is a diagram showing the manner in which the atomic oscillator is fixed in place in the first embodiment.

FIG. 3 is a diagram showing the manner in which the atomic oscillator is fixed in place in the first embodiment.

A timepiece 10 comprises a case 21. This case 21 is formed from a metal (titanium, stainless steel, aluminum, or the like) or a resin.

The periphery of the atomic oscillator 13 accommodated near the peripheral edge of the case 21 is either entirely or partially configured from an insulating material 50 that functions as a thermal separator. In the first embodiment, the entire periphery of the atomic oscillator 13 is covered by the insulating material 50 as shown in FIG. 2B. The material used for the insulating material 50 can be an acrylic, polyethylene, polystyrene, or another such resin.

The atomic oscillator 13 whose periphery is covered by the insulating material 50 is furthermore accommodated within a metal atomic oscillator case 13A. The atomic oscillator case 13A is composed of metal in order to provide antimagnetic properties. The use of this metal atomic oscillator case 13A makes it possible to dispose the atomic oscillator 13 and the electric motor 17 is proximity to each other. Therefore, the layout restrictions can be made less stringent when the atomic oscillator 13 is disposed within the case 21 of the electronic timepiece, and the timepiece can be made thinner and smaller. Furthermore, the atomic oscillator case 13A may have a thermally insulated structure by being coated with a ceramic, a resin, or the like.

Also, the periphery of the atomic oscillator in the case 21 may be given a thermally insulated structure by applying a ceramic coating, a resin coating, or the like.

Furthermore, a casing frame 22 that is formed from a thermally insulating material and that functions as a thermal separator is accommodated in the center portion of the case 21.

Accommodated within the casing frame 22 are a battery 23 as a power source, a timepiece IC 24 that functions as the divider circuit 15 and timepiece drive circuit 16 constituting the atomic oscillator 13 and the timepiece module 12, the electric motor 17, and the gear train 18.

In this case, the atomic oscillator 13 is disposed on the inner peripheral side of the casing frame 22 composed of a thermally insulating material. Disposing the atomic oscillator 13 on the inner peripheral side of the casing frame 22 makes it possible to reduce temperature changes when such changes occur outside of the case 21, and to reduce the effect that temperature changes in the atomic oscillator 13 have on the device characteristics.

The thermally insulating material constituting the casing frame 22 can be an acrylic, polyethylene, polystyrene, or another resin, as well as a ceramic, soda glass, lead glass, or the like.

Also, in the first embodiment, the timepiece module 12 has the shape of a U, and the atomic oscillator case 13A that houses the atomic oscillator 13 is disposed in the hollowed portion of the timepiece module 12.

Supporting units 13A1 extend to the left and right in FIG. 2A from the ends of the atomic oscillator case 13A. Screws SC are screwed into a base plate BP, establishing an electrical connection between a substrate 12A1 on which the wiring of the timepiece module 12 is formed, and a circuit board 13B on which the wiring of the atomic oscillator 13 is formed. The substrate and the circuit board are sandwiched between a press plate FP and the base plate BP, as shown in FIG. 3.

In this timepiece module 12, a rotor 17A of the electric motor 17 described hereinbelow is meshed with a fifth wheel and pinion 51, and a fourth wheel and pinion 52 is meshed with the pinion 51A of the fifth wheel and pinion 51.

A seconds hand constituting the pointer unit 11 is attached to the shaft of the fourth wheel and pinion 52, and the seconds hand is driven along with the rotation of the fourth wheel and pinion 52.

The supporting units 13A1 are not limited to being formed in the left and right directions, and positioning and fixing on the timepiece module 12 may be accomplished with one or more supporting unit. Furthermore, positioning and fixing may be accomplished with conventional positioning and fixing means without the use of screws SC.

A third wheel and pinion 53 is meshed with a pinion 52A of the fourth wheel and pinion 52, and a center wheel and pinion 54 is meshed with a pinion 53A of the third wheel and pinion 53. A minute hand constituting a pointer unit 11 is attached to the shaft of the center wheel and pinion 54, and the minute hand is driven along with the rotation of the center wheel and pinion 54. Also, a minute wheel 55 is meshed with a pinion 54A of the center wheel and pinion 54. An hour wheel (not shown) is meshed with the shaft of the minute wheel, and the rotation of this hour wheel drives an hour hand that constitutes a pointer unit 11 attached to the shaft of the hour wheel.

Furthermore, the minute wheel 55 is meshed with an intermediate minute wheel 56. This intermediate minute wheel 56 is connected to a crown 58 via a time correction gear train 57.

Specifically, the atomic oscillator 13 and the timepiece module 12 must be thermally separated for the following reasons.

(1) The atomic oscillator must be heated and maintained at a specific temperature as necessary, to prevent increases in power consumption that accompany a need for heating when heat escapes to the timepiece module or to the outside (2) To prevent deformation/degradation of the structural material constituting the timepiece module, and the material of the gears and the like (3) To prevent degradation of the lubricating oil applied to the gears and the like (4) To prevent depletion of the battery (5) To prevent deformation/degradation of the circuitry In this case, the heat resistance R between the atomic oscillator 13 and the timepiece module 12 is expressed by the following formula, wherein A is the thermal conductivity of the material connecting the atomic oscillator and the timepiece module, A is the cross-sectional area, and x is the distance therebetween.

$$R=x/(\lambda \cdot A)$$

Therefore, to increase the heat resistance R in order to thermally separate the atomic oscillator 13 and the timepiece module 12, it is preferable that the distance x be increased, the thermal conductivity λ be reduced, and the cross-sectional area A be reduced in cases in which the two are connected.

However, the distance x cannot be very large because the signal wires whereby signals are exchange between the atomic oscillator 13 and the timepiece module 12 must be able to transmit weak signals; i.e., because of the need to exclude unnecessary noise or the like.

In view of this, in the present embodiment, the atomic oscillator case 13A that accommodates the atomic oscillator 13 is disposed in the hollowed portion of the operating module and is spatially separated, so that the effective thermal conductivity A is reduced and the heat resistance R is increased.

Figure 4:
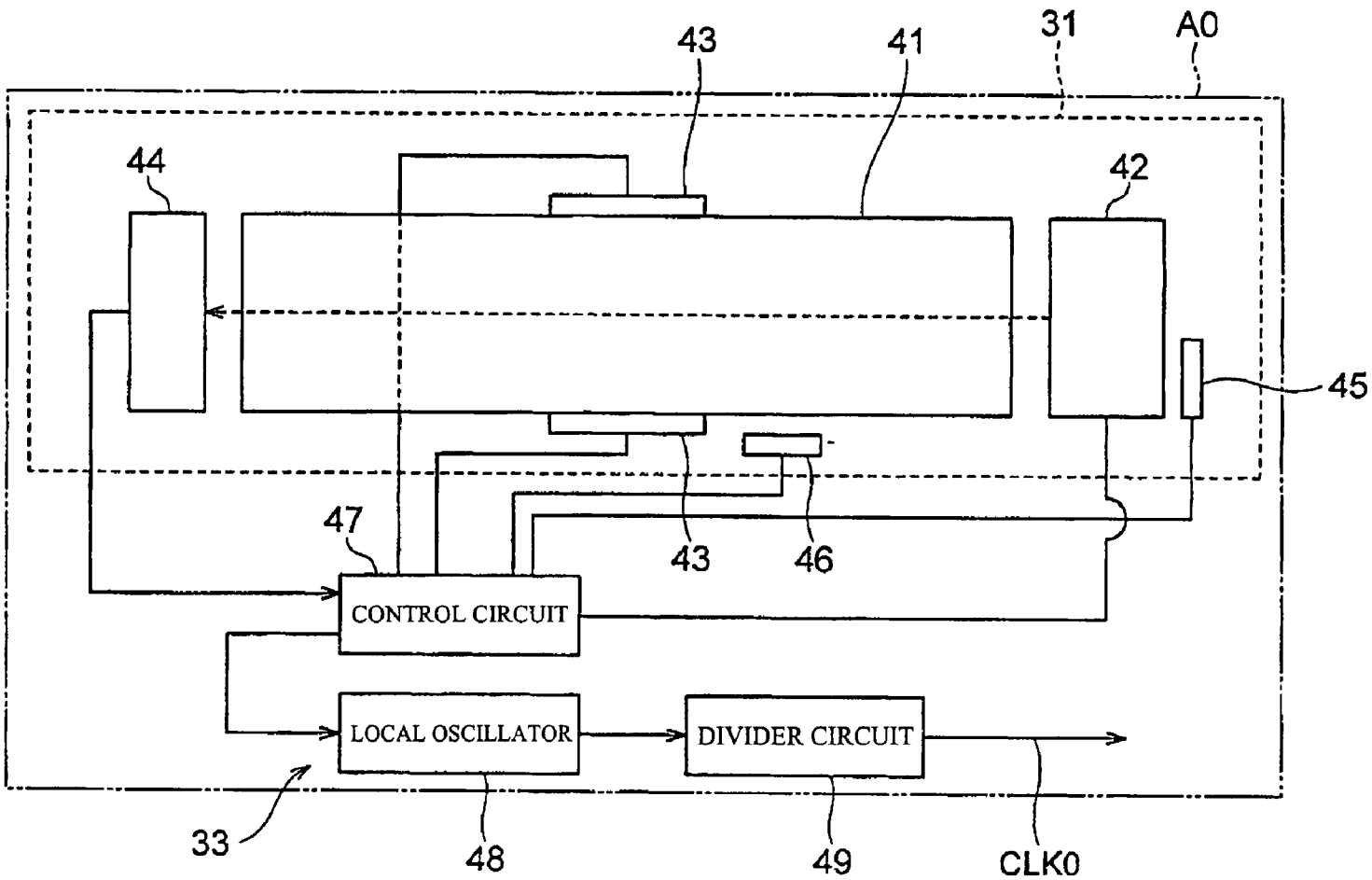
FIG. 4 is an explanatory diagram of an atomic oscillator and thermally insulated part of the first embodiment.

FIG. 4 is an explanatory diagram of the atomic oscillator and the thermally insulated part of the first embodiment.

Broadly classified, an atomic oscillator unit 31 constituting the atomic oscillator 13 comprises a cell 41 in which an alkali metal (cesium) is sealed, a laser diode 42 for irradiating the cell 41 with excitation laser light, a heater 43 for heating the cell 41, a photodiode 44 for receiving the light emitted from the cell 41, a laser temperature sensor 45 for measuring the temperature of the laser diode 42, and a cell temperature sensor 46 for measuring the temperature of the cell 41.

The atomic oscillator 13 uses a cesium atomic oscillator as the atomic oscillator unit 31, and the atomic oscillator unit 31 uses a specific physical phenomenon to verify whether the frequency of the oscillation signal generated by a local oscillator is a specific frequency (=9.2 GHz) under the control of a control circuit 47, described hereinbelow.

A control circuit 33 performs output control for the laser diode 42 on the basis of the temperature of the laser diode as measured by the laser temperature sensor 45, and also performs control for the heater 43 on the basis of the temperature of the cell 41 as measured by the cell temperature sensor 46. The control circuit comprises the control circuit 47 for processing the output signal from the photodiode 44, a local oscillator 48 for converting the frequency of the output signal of the photodiode 44 outputted via the control circuit 47 down to a specific frequency and outputting the converted signal, and a divider circuit 49 for dividing the output signal of the local oscillator 48 and outputting the divided signal as a reference clock signal CLK0.

The control circuit 33 uses as the point of reference the frequency that corresponds to the energy difference between the energy level of the ground state of the cell 41 and the energy level of the excited state that accompanies excitation of the cesium atoms. The control circuit also controls the heater 43 to maintain the cell 41 at a specific temperature. More specifically, the laser diode 42 is modulated so that the frequency difference between the upper side band and lower side band of the output coincides with the characteristic frequency of cesium atoms. The amount of transmitted laser light in the cell 41 is greatest when the frequency difference between the upper side band and the lower side band coincides with the characteristic frequency of cesium atoms. Therefore, the modulation frequency of the laser diode is stabilized based on the characteristic frequency of cesium atoms by adjusting the modulation frequency so that the output of the photodiode 44 is maximized. As a result, the reference clock signal CLK0 is also stabilized based on the characteristic frequency of cesium atoms.

In this case, a thermally insulating configuration is used for the entire atomic oscillator 13 (shown by the thermally insulated part A0 in FIG. 4). The thermally insulated part A0 is configured from a thermally insulating material.

According to this configuration, the operating temperatures of the local oscillator 48 and the laser diode 42 that have certain temperature characteristics can be kept constant, and fluctuations in the output of the reference clock signal CLK0 can be eliminated.

In the above description, only a thermally insulating structure was described, but in actual practice, the atomic oscillator 13 and the shape and arrangement of the thermally insulating structure thereof are also taken into consideration for the antimagnetic properties.

Next, the operation of the embodiment will be described.

When power is supplied to the atomic oscillator 13 and the atomic oscillator 13 generates a reference clock signal CLK0, the divider circuit 15 determines the logic rate of the reference clock signal CLK0 on the basis of correction data set in advance into the data-setting ½ divider circuit. The divider circuit also divides the frequency of the reference clock signal CLK0 and outputs a 1-Hz operating clock signal CLK to the timepiece drive circuit 16.

The timepiece drive circuit 16 thereby drives the electric motor 17.

As a result, the rotor 17A of the electric motor 17 rotatably drives the fifth wheel and pinion 51, and the fourth wheel and pinion 52 is driven via the pinion 51A of the fifth wheel and pinion 51. The seconds hand is driven along with the rotation of the fourth wheel and pinion 52.

Furthermore, the third wheel and pinion 53 is driven via the pinion 52A of the fourth wheel and pinion 52, and the center wheel and pinion 54 is driven via the pinion 53A of the third wheel and pinion 53. The minute hand is driven along with the rotation of the center wheel and pinion 54.

As described above, according to the first embodiment, the atomic oscillator 13 and the timepiece module 12 are disposed so as to be thermally separated, making it possible to prevent deformation/degradation of the structural material constituting the timepiece module 12 and the material of the gears and the like, degradation of the lubricating oil applied to the gears and the like, depletion of the battery 23, and deformation/degradation of the circuitry. Therefore, any resulting reduction in the precision of the time display can be prevented, and an operating clock signal CLK is generated based on an extremely precise reference clock signal CLK0 generated by the atomic oscillator 13, allowing even higher precision to be achieved in the time display. Therefore, the timepiece can be configured as a railroad wristwatch that requires high precision and that is used by subway and other railroad station personnel and train operators.

Furthermore, it is possible to reduce the power loss that accompanies the heat generation of the heater for heating the atomic oscillator 13, and power consumption can consequently be reduced.

[2] Second Embodiment

In the first embodiment described above, the atomic oscillator 13 was accommodated and disposed on the inner peripheral side of the casing frame 22, but in the second embodiment, the atomic oscillator 13 is disposed on part of the case 21 on the outer peripheral side of the casing frame 22.

Figure 5A:
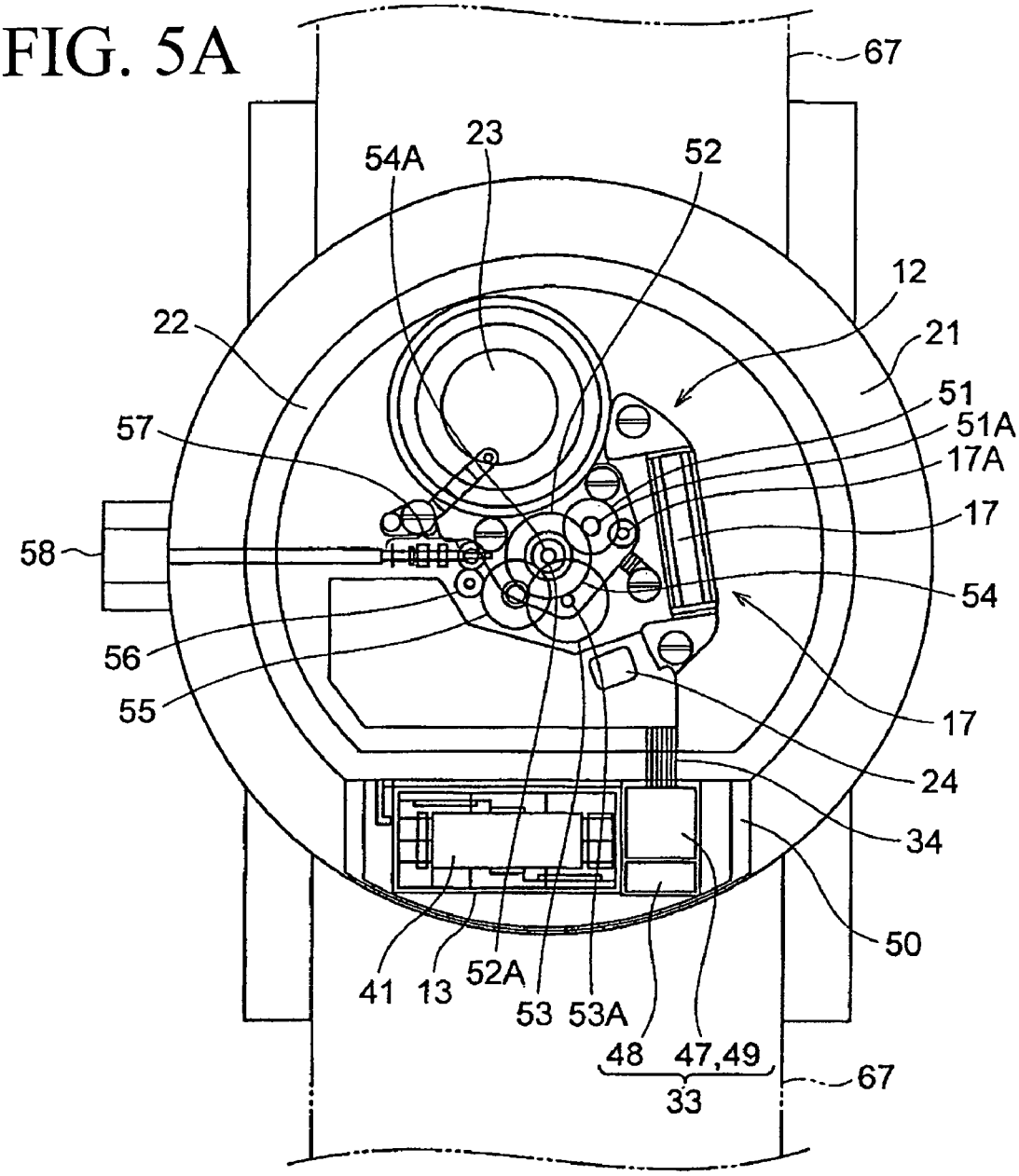
FIG. 5A is a diagram showing the manner in which components are mounted when the timepiece of the second embodiment is viewed from the front.
Figure 5B:
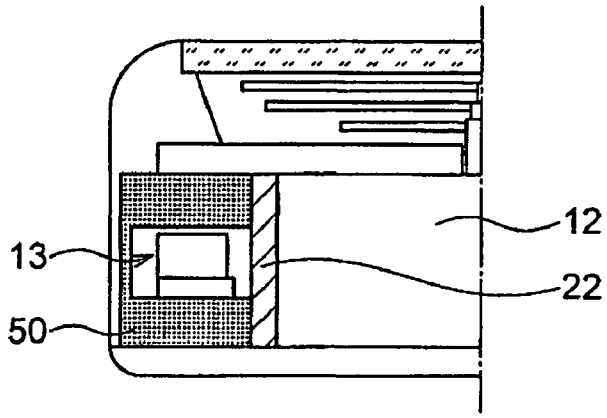
FIG. 5B is a partial cross-sectional view of the timepiece of the second embodiment.

FIGS. 5A and 5B are diagrams showing the manner in which the components of the timepiece are mounted in the second embodiment. FIG. 5A is a diagram showing the manner in which components are mounted when the timepiece of the second embodiment is viewed from the front. FIG. 5B is a partial cross-sectional view of the timepiece of the second embodiment.

A timepiece 10 comprises a case 21. This case 21 is formed from a metal (titanium, stainless steel, aluminum, or the like) or a resin.

The periphery of the atomic oscillator 13 accommodated near the peripheral edge of the case 21 is either entirely or partially configured from an insulating material 50 that functions as a thermal separator. The material used for the insulating material can be an acrylic, polyethylene, polystyrene, or another such resin. Furthermore, the periphery of the atomic oscillator in the case 21 may be given a thermally insulated structure by applying a ceramic coating, a resin coating, or the like.

Also, a casing frame 22 that is formed from a thermally insulating material and that functions as a thermal separator is accommodated in the center portion of the case 21.

The atomic oscillator 13 is fixedly disposed using the thermal separator (insulating material 50, casing frame 22) and the case 21.

Accommodated within the casing frame 22 are a battery 23 as a power source, a timepiece IC 24 that functions as the divider circuit 15 and timepiece drive circuit 16 constituting the timepiece module 12 (drive module), the electric motor 17, and the gear train 18.

The rotor 17A of the electric motor 17 is meshed with a fifth wheel and pinion 51, and a fourth wheel and pinion 52 is meshed with the pinion 51A of the fifth wheel and pinion 51.

A seconds hand constituting the pointer unit 11 is attached to the shaft of the fourth wheel and pinion 52, and the seconds hand is driven along with the rotation of the fourth wheel and pinion 52.

A third wheel and pinion 53 is meshed with a pinion 52A of the fourth wheel and pinion 52, and a center wheel and pinion 54 is meshed with a pinion 53A of the third wheel and pinion 53. A minute hand constituting a pointer unit 11 is attached to the shaft of the center wheel and pinion 54, and the minute hand is driven along with the rotation of the center wheel and pinion 54. Also, a minute wheel 55 is meshed with a pinion 54A of the center wheel and pinion 54. An hour wheel (not shown) is meshed with the shaft of the minute wheel, and the rotation of this hour wheel drives an hour hand that constitutes a pointer unit 11 attached to the shaft of the hour wheel.

Furthermore, the minute wheel 55 is meshed with an intermediate minute wheel 56. This intermediate minute wheel 56 is connected to a crown 58 via a time correction gear train 57.

The atomic oscillator 13 is housed within the case 21 in a state of being thermally separated from the timepiece module 12 via the casing frame 22. Broadly classified, the atomic oscillator 13 comprises an atomic oscillator unit 31 and a control circuit 33, and the control circuit 33 and timepiece module 12 are electrically connected via a flexible circuit board 34.

The control circuit 33 comprises a control circuit 47, a local oscillator 48, and a divider circuit 49.

Taking into consideration the reasons (1) through (4) for thermally separating the atomic oscillator 13 and the timepiece module 12, as well as their relationship with the heat resistance R, a flexible circuit board 34 was used in the second embodiment. Using this board allowed the thermal conductivity λ to be reduced and a configuration having a small cross-sectional area A to be obtained.

Disposing the atomic oscillator 13 on the outer peripheral side of the casing frame 22 makes it possible to develop marketable products in which conventional timepiece modules are used. Specifically, commercial development using conventional timepiece movements is made possible by varying the circuit board and timepiece IC in a conventional timepiece module, and connecting the atomic oscillator 13 to a timepiece module in which such various components are used. As a result, such timepieces can be commercialized at low cost.

[3] Third Embodiment

Figure 6:
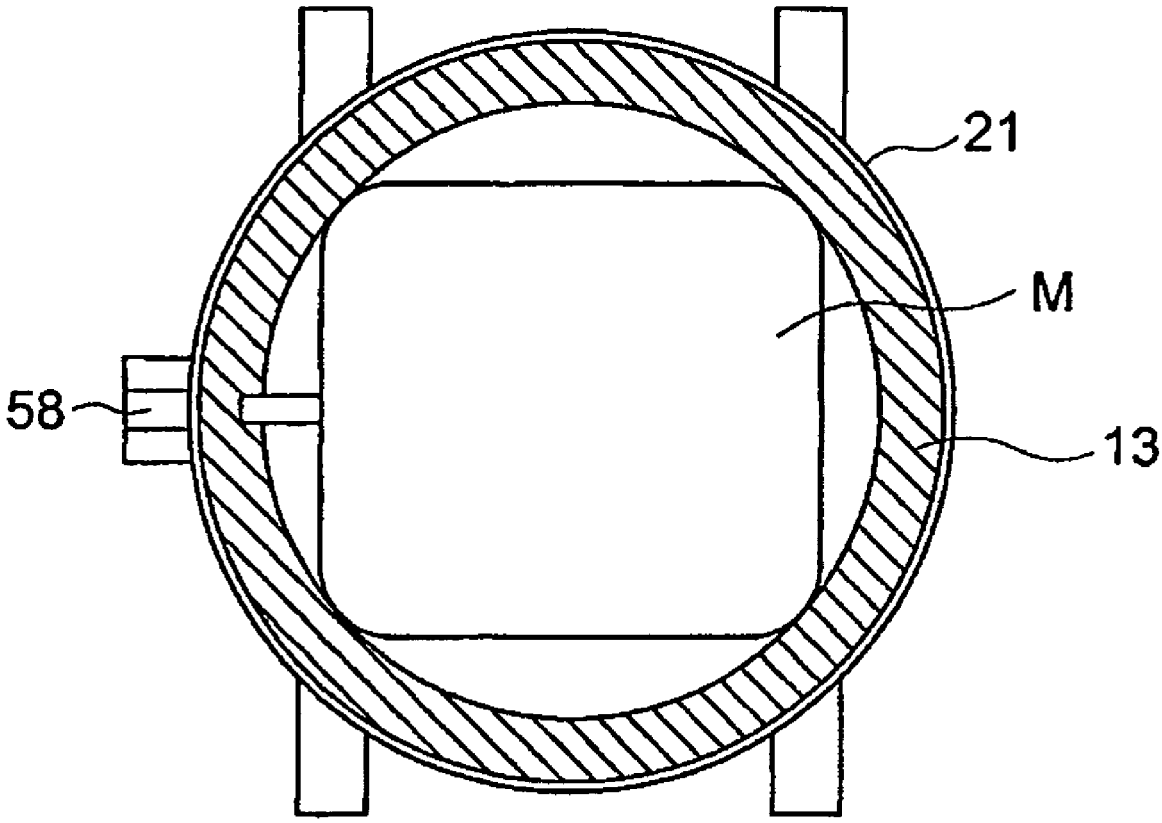
FIG. 6 is an explanatory diagram of the third embodiment.

FIG. 6 is an explanatory diagram of the third embodiment.

In the second embodiment described above, a configuration was used in which the atomic oscillator 13 was disposed on part of the case 21, but another possibility is a configuration in which the atomic oscillator 13 (the hatched portion in FIG. 6) is disposed on the periphery of the case 21 so as to enclose the movement M (which comprises a timepiece module 12B, a battery 23, and the like) of the timepiece.

[4] Fourth Embodiment

Figure 7A:
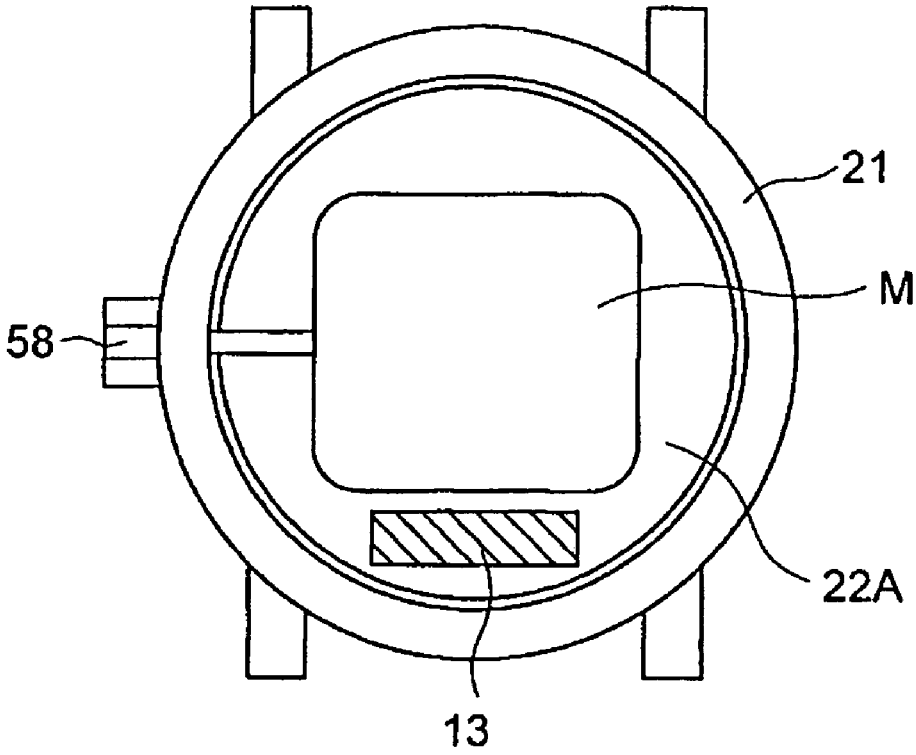
FIG. 7A is a diagram showing the manner in which components are mounted when the timepiece of the fourth embodiment is viewed from the front.
Figure 7B:
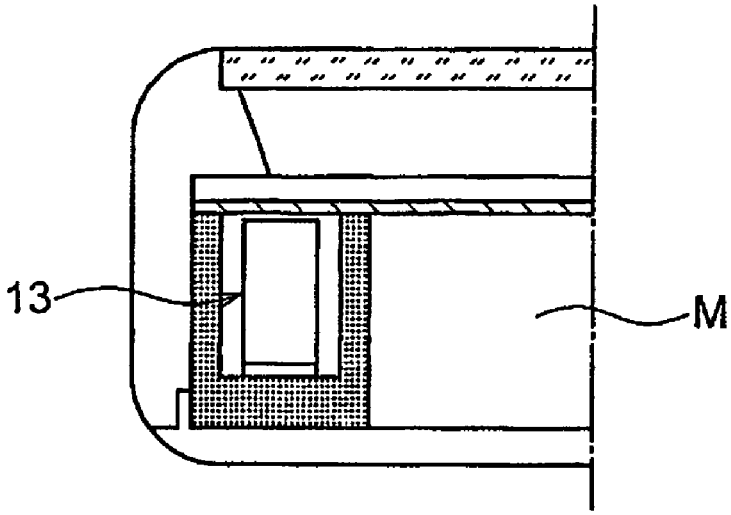
FIG. 7B is a partial cross-sectional view of the timepiece of the fourth embodiment.

FIGS. 7A and 7B are diagrams showing the manner in which the components of the timepiece are mounted in the fourth embodiment. FIG. 7A is a diagram showing the manner in which components are mounted when the timepiece of the fourth embodiment is viewed from the front. FIG. 7B is a partial cross-sectional view of the timepiece of the fourth embodiment.

In the first and second embodiments described above, the atomic oscillator 13 was disposed on a portion of the case 21, but in the fourth embodiment, the atomic oscillator 13 is accommodated within the casing frame 22.

In this case, the casing frame 22 is formed from a thermally insulating material, and the atomic oscillator 13 is covered with a thermally insulating material.

The thermally insulating material can be an acrylic, polyethylene, polystyrene, or another such resin, as well as a ceramic, soda glass, lead glass, or the like.

Also, the atomic oscillator 13 is covered by a metal case. This metal case may be given a thermally insulated structure by being coated with a ceramic, a resin, or the like.

[5] Fifth Embodiment

Figure 8:
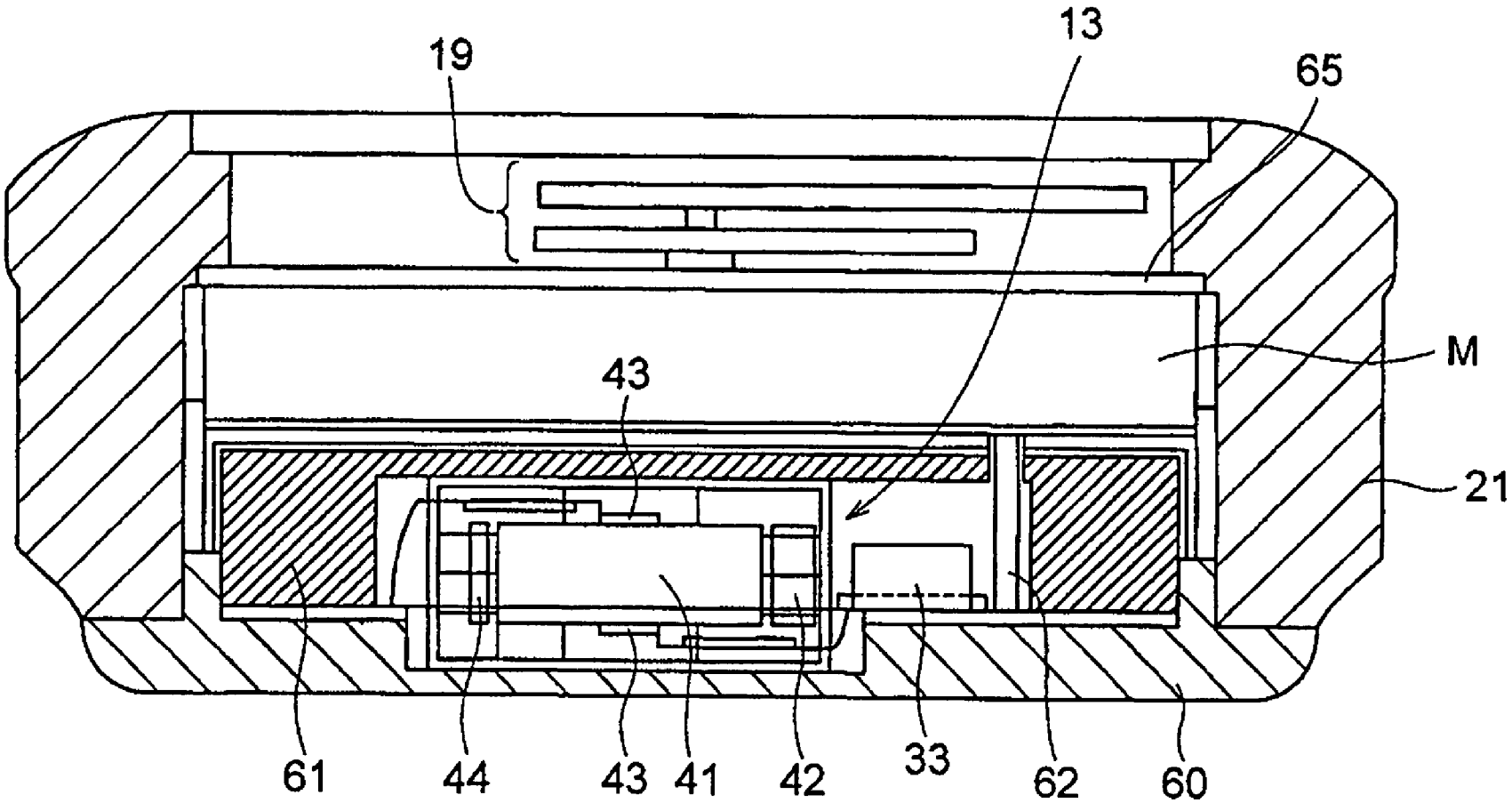
FIG. 8 is an explanatory diagram of the fifth embodiment.

FIG. 8 is an explanatory diagram of the fifth embodiment.

In the embodiments described above, the atomic oscillator 13 was disposed at an arbitrary location on the periphery of the movement M in plan view, but in the fifth embodiment, the atomic oscillator 13 is superposed over the reverse side of the movement M.

The atomic oscillator 13 is accommodated on the reverse side (opposite side of the pointer unit 11) of the movement M while enclosed by a case back 60 and a thermally insulating material 61, and is mounted on the case back 60.

The movement M and the atomic oscillator 13 are electrically connected by a coil spring 62, enabling signal transfer. Particularly in cases in which the coil spring 62 is used, even if the output frequency of the reference clock signal CLK0 is varied to promote commercial development, optimum signal transfer can be easily achieved merely by varying the wire diameter, the number of windings, or the outside diameter of the coil spring 62, without varying other structural components.

The use of the coil spring 62 makes it possible to further increase the distance x between the movement M and the atomic oscillator 13. As a result, the heat resistance R (refer to the above-described formula for heat resistance R) can be increased, the conduction of heat from the atomic oscillator 13 to the movement M can be reduced, and the thermal insulation properties can be improved.

Another possibility is a configuration in which electrically conductive rubber is used instead of the coil spring 62.

The case back 60 is a metal [without a coating] or a metal with a thermally insulating coating composed of a ceramic or resin material. In this case, the cell 41 constituting the atomic oscillator unit 31 may be covered by a metal case.

The thermally insulating material 61 can be an acrylic, polyethylene, polystyrene, or another such resin, as well as a ceramic, soda glass, lead glass, or the like.

[6] Sixth Embodiment

Figure 9A:
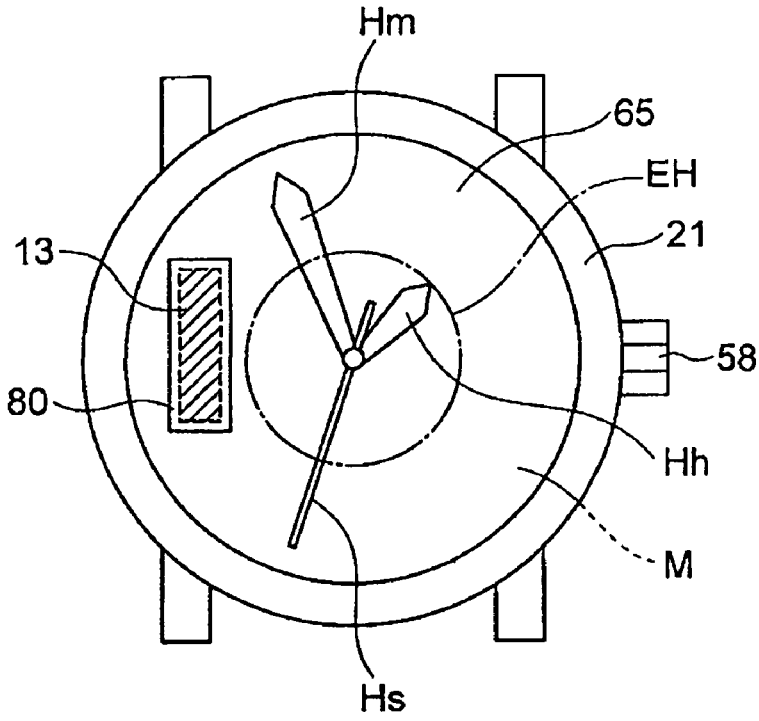
FIG. 9A is a plan view of the timepiece of the sixth embodiment.
Figure 9B:
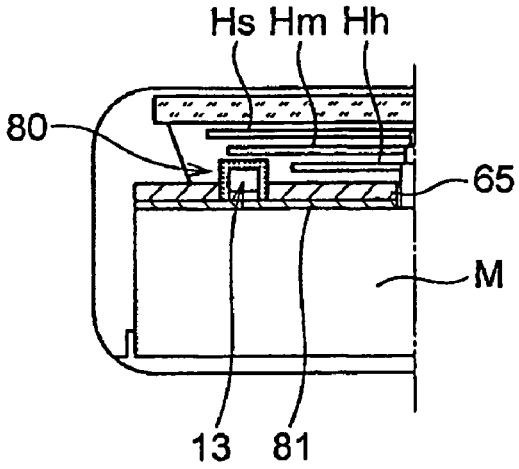
FIG. 9B is an explanatory diagram of a first aspect of the sixth embodiment.
Figure 9C:
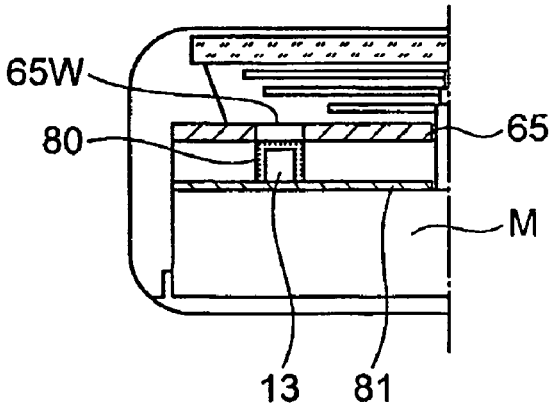
FIG. 9C is an explanatory diagram of a second aspect of the sixth embodiment.

FIGS. 9A, 9B, and 9C are diagrams showing the manner in which components are mounted in the timepiece of the sixth embodiment. FIG. 9A is a plan view of the timepiece of the sixth embodiment, FIG. 9B is an explanatory diagram of a first aspect of the sixth embodiment, and FIG. 9C is an explanatory diagram of a second aspect of the sixth embodiment.

In the fifth embodiment described above, the atomic oscillator 13 was superposed on the reverse side of the movement M, but in the sixth embodiment, the atomic oscillator 13 is disposed on a dial.

The atomic oscillator 13 is covered by a thermally insulating material 80 used as a thermally insulating means, is disposed on a second thermally insulating material 81 used as a thermally insulating means for the underside of a dial 65, and is thermally separated from the movement M in the interior. In this case, the atomic oscillator 13 and the thermally insulating material 80 are disposed closer to the dial 65 and away from a plane that includes the rotational trajectory of a minute hand Hm, and are disposed closer to the outside and away from the rotational trajectory EH of the distal end of an hour hand Hh, as shown in FIG. 9B. Furthermore, the atomic oscillator 13 and the thermally insulating material 80 are inserted from below into a hole provided in the dial 65, and the top surfaces thereof protrude upward from the dial 65.

The dial 65 may be configured from a base material alone, and the configuration of the dial may be coated with a resin on both the top and bottom surfaces of the base material.

A case was described above in which the atomic oscillator 13 and the thermally insulating material 80 were inserted from below into a hole provided in the dial 65, and the top surfaces thereof protruded upward from the dial 65. However, another possibility is to form a viewing window 65W fitted with a light-transmissive material such as a transparent ceramic, soda glass, or lime glass in the dial 65, and to dispose the atomic oscillator 13 (and the thermally insulating material 80) underneath to allow viewing through the viewing window 65W, as shown in FIG. 9C. Another possibility is to not provide the viewing window 65W, and to configure the top surface of the thermally insulating material 80 at the same height as the front surface on the visible side of the dial 65. Yet another possibility is to dispose the movement M between the dial 65 and the second thermally insulating material 81.

As described above, according to the sixth embodiment, disposing the atomic oscillator 13 on the dial 65 or at a position at which the atomic oscillator can be viewed through the dial 65 makes it possible to easily ascertain that the timepiece is equipped with an atomic oscillator 13 from the outward appearance of the timepiece, and to conduct commercial development with a wide range of design variation.

[7] Seventh Embodiment

Figure 10:
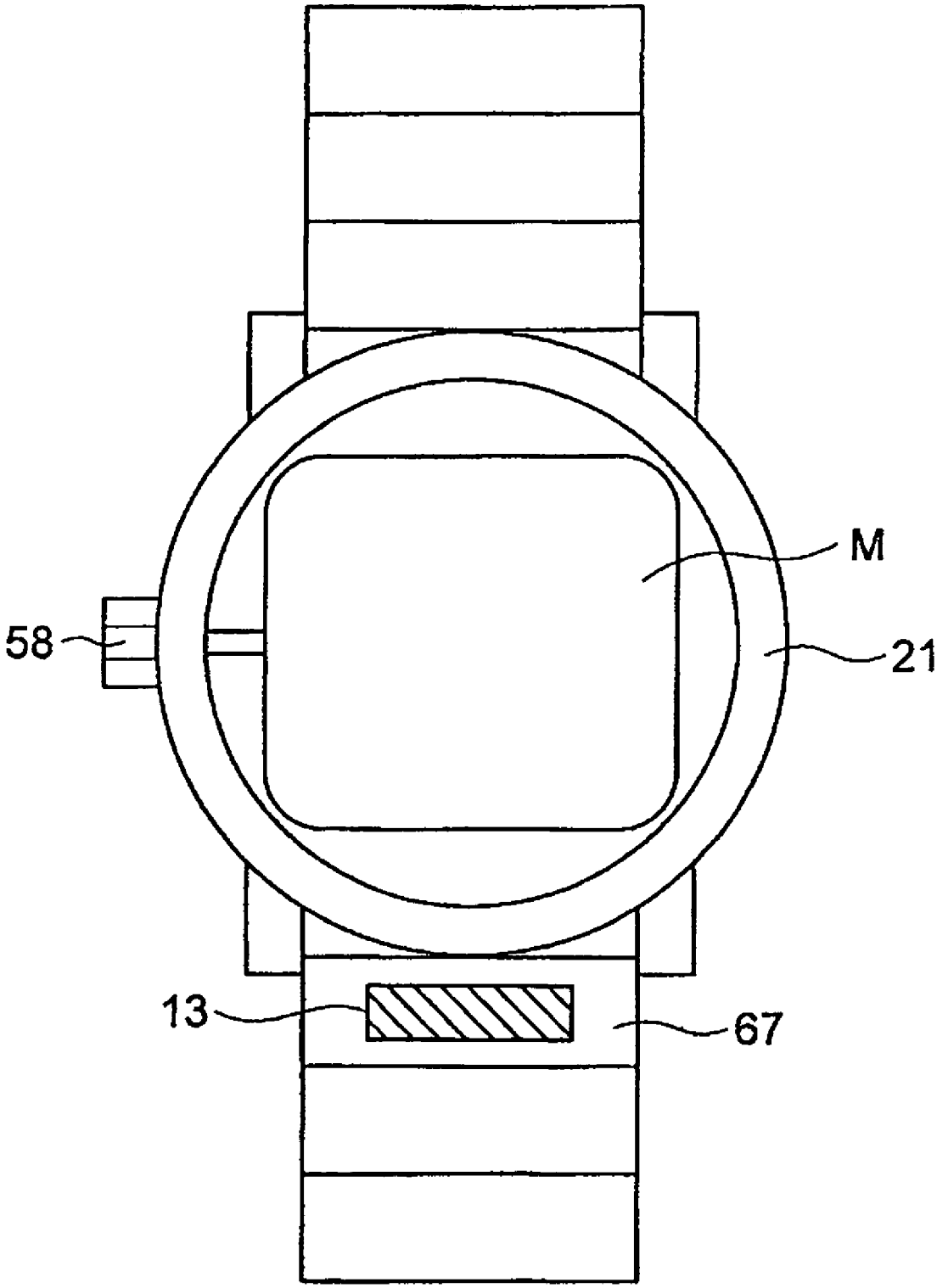
FIG. 10 is an explanatory diagram of the seventh embodiment.

FIG. 10 is an explanatory diagram of the seventh embodiment.

In the embodiments described above, the atomic oscillator 13 was disposed inside the case 21, but in the seventh embodiment, the atomic oscillator is accommodated inside a timepiece band.

The atomic oscillator 13 is disposed within a timepiece band 67.

In this case, either the timepiece band 67 is configured from a thermally insulating material, or the atomic oscillator 13 is covered by a thermally insulating material.

In cases in which the timepiece band 67 is configured form a thermally insulating material, the material may be an acrylic, polyethylene, polystyrene, or another such resin; or rubber or the like.

In cases in which the timepiece band 67 is configured from a metal, the periphery of the atomic oscillator 13 may be given a thermally insulated structure by coating the periphery with a ceramic, resin, or the like.

In this case, the atomic oscillator 13 is preferably provided with an amplifier for amplifying the signals. The amplifier is needed because the atomic oscillator 13 is located at a distance from the movement M that includes the timepiece module, resulting in a longer signal wiring that tends to pick up noise.

Disposing the atomic oscillator 13 inside the timepiece band 67 makes it easier for a timepiece equipped with an atomic oscillator 13 to be made thinner and smaller. Furthermore, commercial development using a conventional timepiece movement is made easier, similar to the previous description.

[8] Eighth Embodiment

Figure 11:
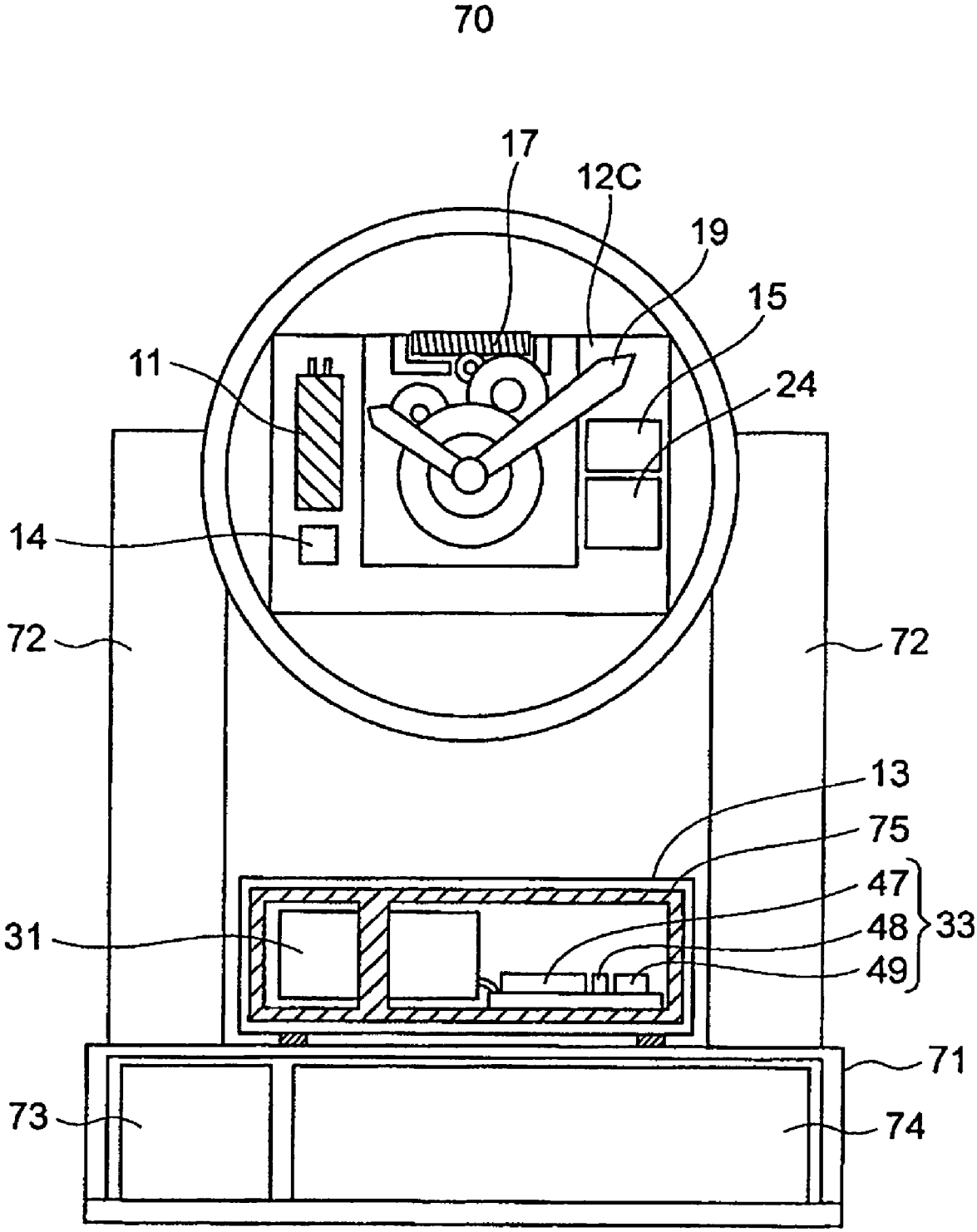
FIG. 11 is an explanatory diagram of the eighth embodiment.

FIG. 11 is an explanatory diagram of the eighth embodiment

In the embodiments described above, a wristwatch was described as an example, but in the eighth embodiment, the timepiece is configured as a standing clock.

In FIG. 11, components similar to those in FIGS. 1, 2, and 4 are denoted by the same numerical symbols.

A timepiece (electronic timepiece) 70 is configured as a portable standing clock, and, broadly classified, comprises a base 71, a timepiece module 12C and a pointer unit 11 held at the top by a brace 72 erected on the base 71, an AC/DC converter unit 73 that is accommodated inside the base 71 and that converts AC power to DC power when AC power has been supplied, a battery 74 for storing the DC power supplied from the AC/DC converter unit 73, and an atomic oscillator 13 installed on the base 71.

In this case, the atomic oscillator 13 is covered by a thermally insulating material 75.

The atomic oscillator 13 is provided with an amplifier for amplifying the signals. The amplifier is needed because the atomic oscillator 13 is distanced from the timepiece module 12C, resulting in a longer signal wiring that tends to pick up noise.

The operation of the timepiece 70 is identical to the previous embodiments, and a detailed description is therefore omitted.

As described above, according to the second through eighth embodiments, the atomic oscillator 13 and the timepiece module (12, 12B, 12C) are disposed so as to be thermally separated. Therefore, it is possible to prevent deformation/degradation of the structural material constituting the timepiece module (12, 12B, 12C) and the material of the gears and the like, degradation of the lubricating oil applied to the gears and the like, depletion of the battery 23, and deformation/degradation of the circuitry. Any resulting reduction in the precision of the time display can therefore be prevented.

Furthermore, it is possible to reduce the power loss that accompanies heat generation, and power consumption can consequently be reduced.

[9] Ninth Embodiment

Figure 12:
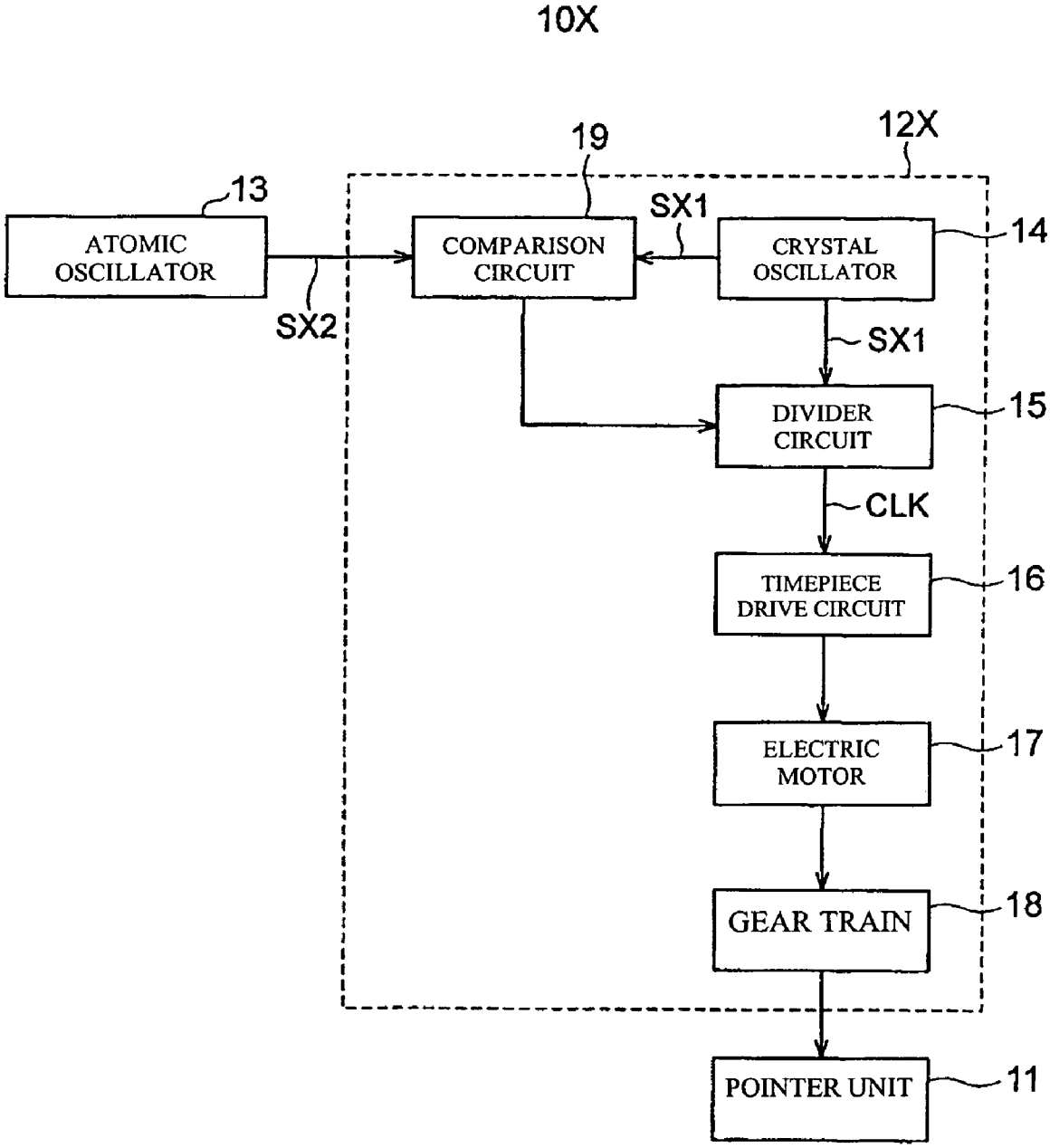
FIG. 12 is a block diagram showing the schematic configuration of the timepiece of the ninth embodiment.

FIG. 12 is a block diagram showing the schematic configuration of the timepiece of the ninth embodiment. In FIG. 12, components similar to those in the first embodiment in FIG. 1 are denoted by the same numerical symbols.

A timepiece (electronic timepiece) 10X is configured as a wristwatch, and, broadly classified, comprises a timepiece module 12X as an operating module provided with a crystal oscillator 14 for generating and outputting a first oscillation signal SX1, and an atomic oscillator 13 for generating and outputting a second oscillation signal SX2 that has higher precision than the first oscillation signal SX1.

In this case as well, the timepiece module 12X and the atomic oscillator 13 are disposed so as to be separated in three dimensions, similar to the previous embodiments. More specifically, the timepiece module 12X and the atomic oscillator 13 are disposed so that their orthogonal projections onto a specific plane (a plane parallel to their front surfaces) do not overlap.

Furthermore, the timepiece module 12X comprises the crystal oscillator 14 described above; a frequency/phase comparison circuit 19 for comparing the frequencies and phases of the first oscillation signal SX1 generated by the crystal oscillator 14 and a second oscillation signal SX2 generated by the atomic oscillator 13; a divider circuit 15 for dividing the first oscillation signal SX1 on the basis of the comparison results of the frequency/phase comparison circuit 19, and generating and outputting a reference clock signal CLK; a timepiece drive circuit 16 for driving a timepiece mechanism on the basis of the reference clock signal CLK; an electric motor 17 that constitutes the timepiece mechanism and that is controlled by the timepiece drive circuit 16; and a gear train 18 for transmitting the drive force of the electric motor 17.

In this case, the timepiece module 12X comprises a crystal oscillator 14 and a comparison circuit 19, but otherwise has the same configuration as the timepiece module 12 of the first embodiment. Therefore, the following description refers to FIGS. 2 through 4.

In this timepiece module 12X, a rotor 17A of the electric motor 17 described hereinbelow is meshed with a fifth wheel and pinion 51, and a fourth wheel and pinion 52 is meshed with the pinion 51A of the fifth wheel and pinion 51.

A seconds hand constituting the pointer unit 11 is attached to the shaft of the fourth wheel and pinion 52, and the seconds hand is driven along with the rotation of the fourth wheel and pinion 52.

A third wheel and pinion 53 is meshed with a pinion 52A of the fourth wheel and pinion 52, and a center wheel and pinion 54 is meshed with a pinion 53A of the third wheel and pinion 53. A minute hand constituting a pointer unit 11 is attached to the shaft of the center wheel and pinion 54, and the minute hand is driven along with the rotation of the center wheel and pinion 54. Also, a minute wheel 55 is meshed with a pinion 54A of the center wheel and pinion 54. An hour wheel (not shown) is meshed with the shaft of the minute wheel, and the rotation of this hour wheel drives an hour hand that constitutes a pointer unit 11 attached to the shaft of the hour wheel.

The minute wheel 55 is meshed with an intermediate minute wheel 56. This intermediate minute wheel 56 is connected to a crown 58 via a time correction gear train 57.

A pointer unit 11 comprising a seconds hand, a minute hand, an hour hand, and other pointers is connected to the gear train 18.

The crystal oscillator 14 uses a configuration wherein a tuning fork-type crystal oscillator is oscillated, and, e.g., a first oscillation signal SX1 of 32.768 kHz is outputted.

In the divider circuit 15, dividers that include a data-setting ½ divider circuit for setting a logic rate are connected in several stages, the first oscillation signal SX1 and the second oscillation signal SX2 are divided to 1 Hz as a correction reference, and a 1-Hz clock signal CLK is outputted.

Next, the operation of the ninth embodiment will be described.

In the present embodiment, the timepiece is presumed to be a wristwatch or another such small portable timepiece, and the atomic oscillator 13 is therefore driven intermittently (every three hours in the present embodiment) in order to reduce power consumption.

Figure 13:
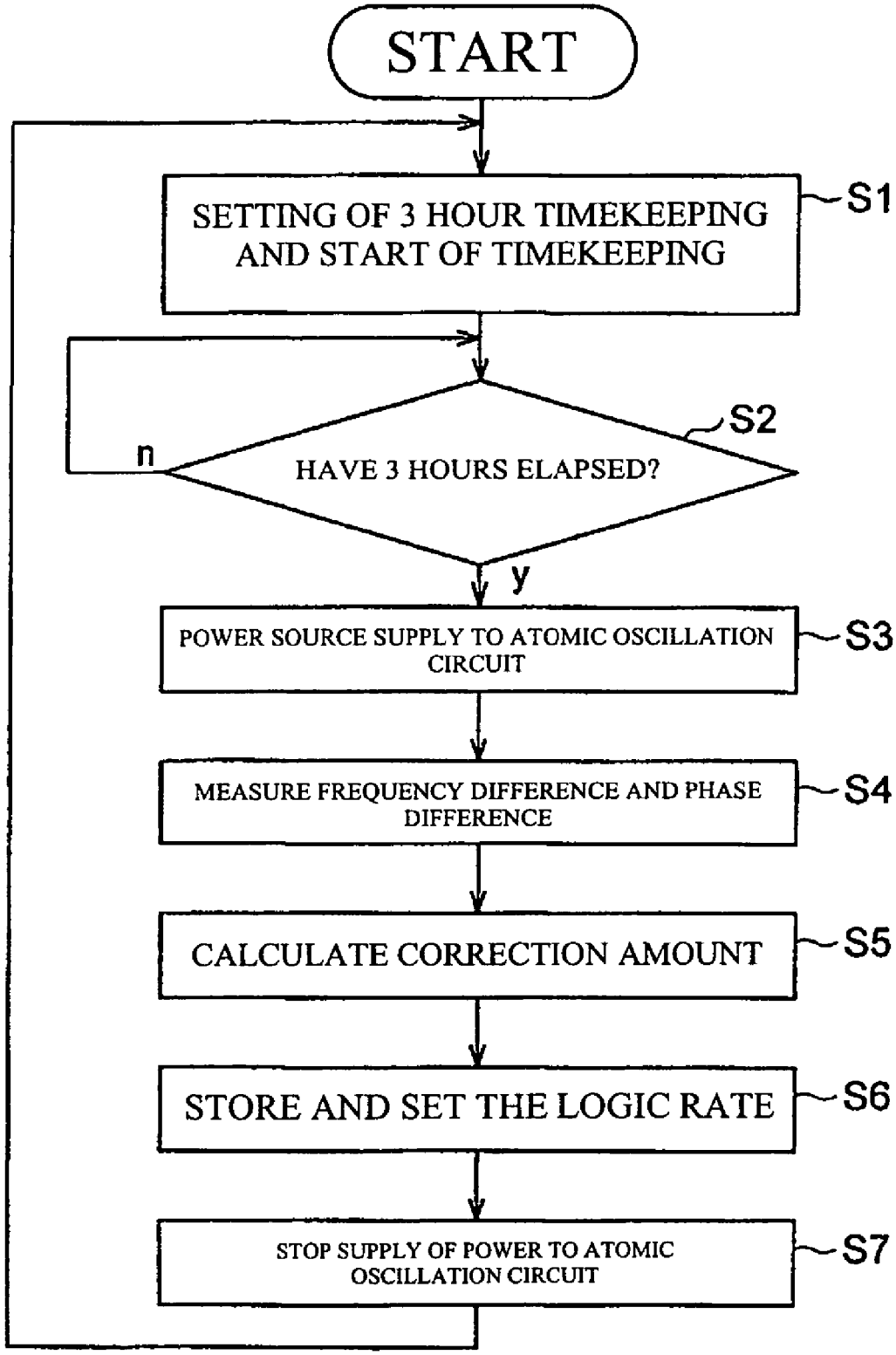
FIG. 13 is an operation flowchart centered on the oscillation operation.

FIG. 13 is an operation flowchart centered on the oscillation operation.

After the previous intermittent operation is complete, a counter (not shown) is reset, timekeeping is begun (step S1), and a determination is made based on the counter value of the counter as to whether the non-drive period (three hours) of the atomic oscillator 13 has elapsed (step S2).

In cases in which it is determined in step S2 that the non-drive period of the atomic oscillator 13 is still in effect (step S2; n), the divider circuit 15 determines the logic rate of the first oscillation signal SX1, divides the frequency of the first oscillation signal SX1, and outputs a 1-Hz clock signal CLK to the timepiece drive circuit 16 on the basis of correction data (or specific correction data at the first time) previously set by the data-setting ½ divider circuit.

The timepiece drive circuit 16 thereby drives the electric motor 17.

As a result, the rotor 17A of the electric motor 17 rotatably drives the fifth wheel and pinion 51, and the fourth wheel and pinion 52 is driven via the pinion 51A of the fifth wheel and pinion 51. The seconds hand is driven along with the rotation of the fourth wheel and pinion 52.

Furthermore, the third wheel and pinion 53 is driven via the pinion 52A of the fourth wheel and pinion 52, and the center wheel and pinion 54 is driven via the pinion 53A of the third wheel and pinion 53. The minute hand is driven along with the rotation of the center wheel and pinion 54.

Furthermore, the minute wheel 55 meshed with the pinion 54A of the center wheel and pinion 54 is driven, and an hour wheel (not shown) is driven to drive the hour hand.

As a result, the current time is displayed.

In cases in which it is determined in step S2 that the non-drive period of the atomic oscillator 13 has elapsed (step S2: y), then power is supplied to the atomic oscillator 13 and the operation of the atomic oscillator unit 31 is begun (step S3).

Next, after a sufficient amount of time has elapsed for the oscillation frequency of the atomic oscillator 13 to stabilize after the supply of power has begun, the frequency/phase comparison circuit 19 measures the frequency difference and phase difference between the first oscillation signal SX1 and the second oscillation signal SX2 (step S4), and outputs correction data to the divider circuit 15 on the basis of the frequency difference and phase difference.

The correction data is outputted to and stored in the data-setting ½ divider circuit of the divider circuit 15.

When a drive period (10 seconds, for example) has subsequently elapsed that is sufficient for the process described above to be completed after power has begun to be supplied to the atomic oscillator 13, the power to the atomic oscillator 13 is again shut off, and the process is again returned to step S1 (step S7). Similarly, the amount of phase deviation in the 1 Hz clock signal CLK is corrected based on the correction data (logic rate) stored in the data-setting ½ divider circuit while the atomic oscillator 13 is not operating. The process is repeated every three hours so that the correction data (logic rate) is renewed and the phase deviation of the clock signal CLK is corrected based on the frequency difference and phase difference between the second oscillation signal SX2 outputted by the atomic oscillator 13 and the first oscillation signal SX1 outputted by the crystal oscillator 14.

In parallel with this process, the divider circuit 15 determines the logic rate of the first oscillation signal SX1, divides the frequency of the first oscillation signal SX1, and outputs a 1-Hz clock signal CLK to the timepiece drive circuit 16 on the basis of newly set correction data.

The timepiece drive circuit 16 thereby drives the electric motor 17.

As a result, the rotor 17A of the electric motor 17 rotatably drives the fifth wheel and pinion 51, and the fourth wheel and pinion 52 is driven via the pinion 51A of the fifth wheel and pinion 51. The seconds hand is driven along with the rotation of the fourth wheel and pinion 52.

Furthermore, the third wheel and pinion 53 is driven via the pinion 52A of the fourth wheel and pinion 52, and the center wheel and pinion 54 is driven via the pinion 53A of the third wheel and pinion 53. The minute hand is driven along with the rotation of the center wheel and pinion 54.

As described above, according to the ninth embodiment, the atomic oscillator 13 and the timepiece module 12X are disposed so as to be thermally separated, making it possible to prevent deformation/degradation of the structural material constituting the timepiece module 12X and the material of the gears and the like, degradation of the lubricating oil applied to the gears and the like, depletion of the battery 23, and deformation/degradation of the circuitry. Therefore, any resulting reduction in the precision of the time display can be prevented, and a clock signal CLK is generated based on an extremely precise reference clock signal (which is equivalent to oscillation signal SX2) generated by the atomic oscillator 13, allowing for an even higher precision in the time display. Therefore, the timepiece can be configured as a railroad wristwatch that requires high precision and that is used by subway and other railroad station personnel and train operators.

Furthermore, it is possible to reduce the power loss that accompanies the heat generation of the heater for heating the atomic oscillator 13, and power consumption can consequently be reduced.

Modifications of the ninth embodiment will now be described.

[9.1] First Modification

In the above description, a case was described in which the frequencies and phases were compared between the first oscillation signal SX1 outputted by the crystal oscillator 14 (*2) and the second oscillation signal SX2 outputted by the atomic oscillator 13, but it is also possible to design the configuration so that only the phases are compared if the frequencies of the first oscillation signal SX1 and the second oscillation signal SX2 are equal to each other.

Another possibility is to compare the frequencies between the first oscillation signal SX1 and the second oscillation signal SX2, and to allow the oscillation frequency of the first oscillation signal SX1 outputted by the crystal oscillator 11 to be corrected based on the frequency of the second oscillation signal SX2 outputted by the atomic oscillator 13.

[9.2] Second Modification

In the above description, a logic rate system was used as the system for correcting the reference clock signal CLK, but another possibility is to use both a logic rate system and a variable-capacitance system for a crystal oscillator. In this case, the adjustable range of the reference clock signal CLK can be increased by using both the logic rate system and the variable-capacitance system. The correction system is not limited to providing the crystal oscillator with a capacitance-varying capacitor, and a capacitance-varying capacitor may also be provided to components other than the crystal oscillator.

[9.3] Third Modification

An example was described above in which the non-drive period of the atomic oscillator 13 was set to 3 hours and the drive period was set to 10 seconds, but these periods are not limited by these options alone and may be set to any arbitrary time periods.

Also, the intermittent drive periods need not be equal to each other. The intermittent drive periods may be set, for example, to unequal intervals so that the non-drive period is reduced during the daytime slot (two hours, for example) and increased during the nighttime slot (four hours, for example).

[9.4] Fourth Modification

In the above description, a cesium atomic oscillator was used as the atomic oscillator unit 31, but another type of atomic oscillator (a rubidium atomic oscillator, for example) may also be used. Also, the crystal oscillator 11 may be an oscillator used in a VHP timepiece or a HP (high-precision) timepiece, or another such arbitrary crystal oscillator.

[10] Effects of the Embodiments

According to these embodiments, in cases in which an atomic oscillator is used as a reference oscillator in a portable timepiece or an electronic device, the portable timepiece or the electronic device can be designed while the effect of heat on the timepiece or device is reduced.

Also, power loss that accompanies the evolved heat can be reduced, and power consumption can be lowered as a result. Furthermore, the present invention is particularly effective in cases in which the present invention is applied to a portable timepiece or electronic device that is relatively small and has a low degree of freedom in its layout. This is because the product (portable timepiece or electronic device) can be compactly designed.

Furthermore, power loss that accompanies the evolved heat can be reduced, and power consumption can be lowered as a result.

[11] Modifications of the Embodiments

The embodiments described above depict only one aspect of the present invention, and can be arbitrarily modified within the range of the present invention.

[11.1] First Modification

Figure 14:
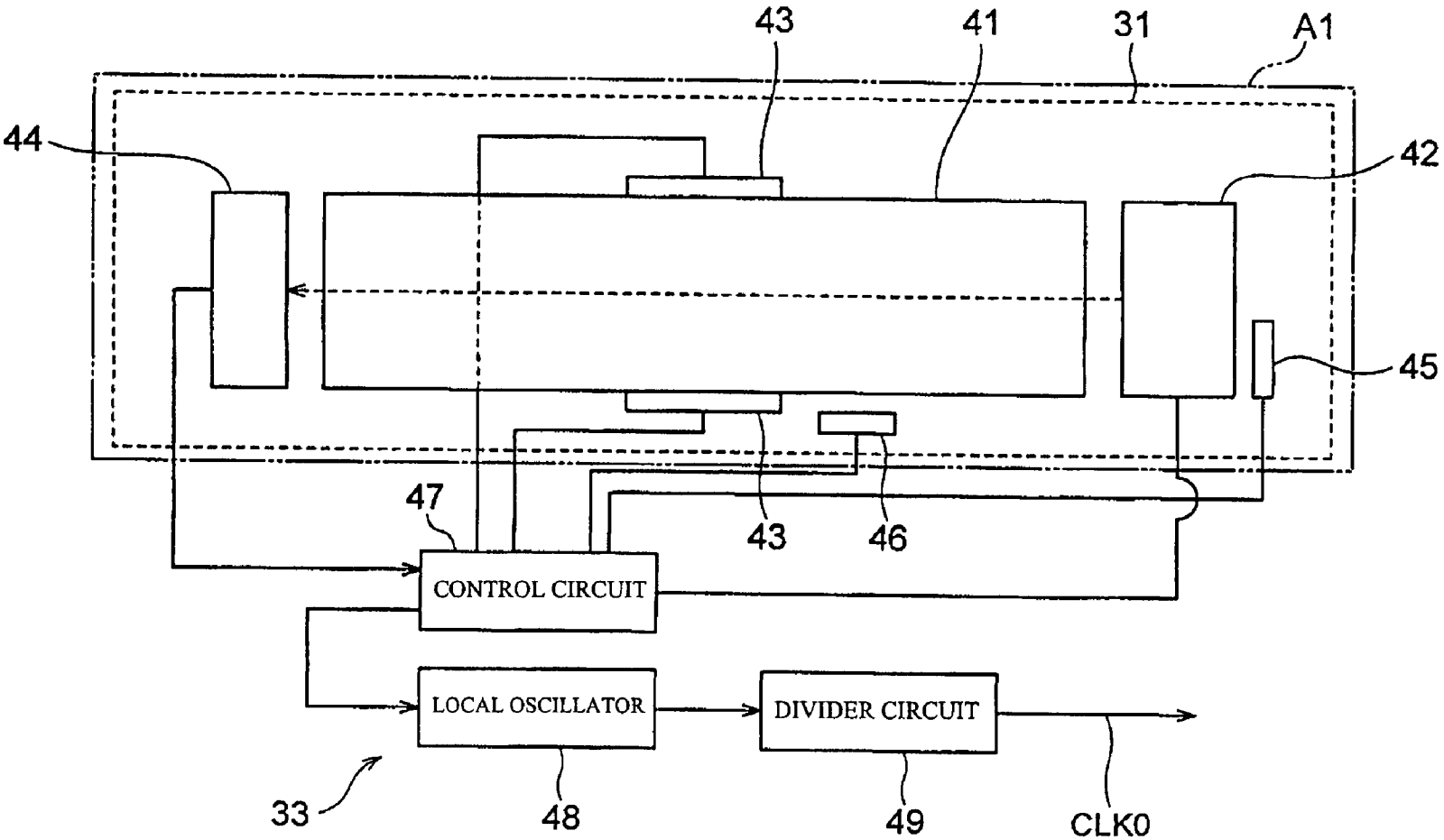
FIG. 14 is an explanatory diagram of the first modification.

FIG. 14 is an explanatory diagram of the first modification.

In the above description, a configuration was used in which the entire atomic oscillator 13 (indicated as a thermally insulated part A0 in FIG. 4) was thermally insulated, but also possible is a configuration in which the cell 41, the heater 43, the cell temperature sensor 46, the laser diode 42, the photodiode 44, and the laser temperature sensor 45 of the atomic oscillator 13 are thermally insulated. Specifically, the atomic oscillator unit 31 (indicated as a thermally insulated part A1 in FIG. 14) may be thermally insulated. The thermally insulated part A1 is herein configured from a thermally insulating material.

According to the configuration described above, the operating temperature of the laser diode 42 having certain temperature characteristics can be kept constant, and fluctuations in the output of the reference clock signal CLK0 can therefore be eliminated.

[11.2] Second Modification

Figure 15:
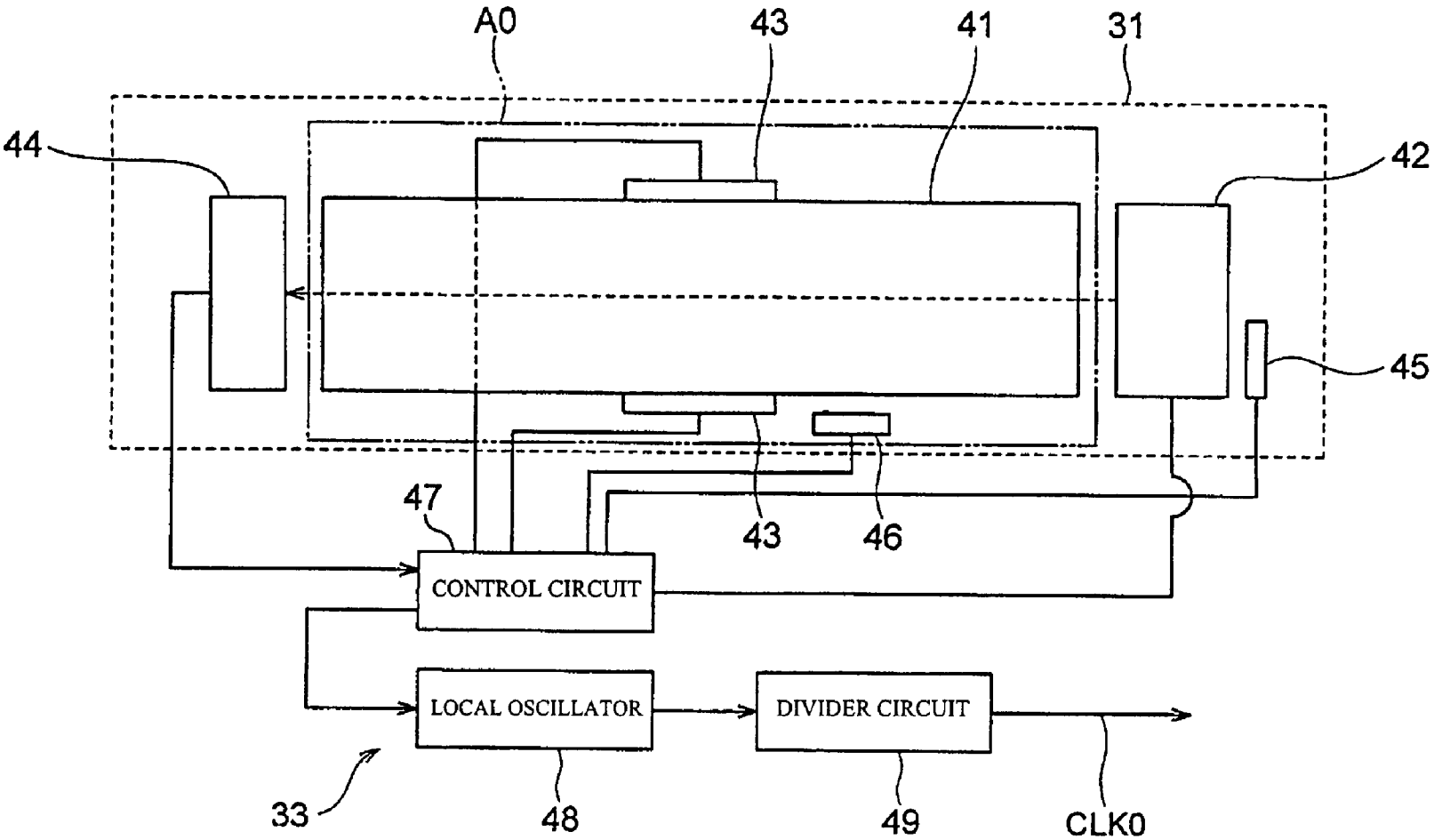
FIG. 15 is an explanatory diagram of the second modification.

FIG. 15 is an explanatory diagram of the second modification.

In the description of the first modification, a configuration was used in which the cell 41, the heater 43, the cell temperature sensor 46, the laser diode 42, the photodiode 44, and the laser temperature sensor 45 of the atomic oscillator 13 were thermally insulated, but another possibility is a configuration (indicated as a thermally insulated part A2 in FIG. 13) in which the cell 41, the heater 43, and the cell temperature sensor 46 of the atomic oscillator 13 are thermally insulated. The thermally insulated part A2 herein is configured from a thermally insulating material.

According to the configuration described above, the operating temperature of the cell 41, which is part most susceptible to the effects of temperature changes, can be kept constant, and fluctuations in the output of the reference clock signal CLK0 can therefore be eliminated.

[11.3] Third Modification

In the above description, a cesium atomic oscillator was used as the atomic oscillator 13, but another type of atomic oscillator (a rubidium atomic oscillator, for example) may also be used.

[11.4] Fourth Modification

In the above description, the battery 23 may be a lithium battery, silver battery, or other coin-type primary battery. Another possibility is to use a secondary battery, as the battery 23, used along with a power-generating means. For example, the power-generating means may be a power-generating device converting kinetic energy to electrical energy, where the kinetic energy of an oscillating weight rotated by gravity is transmitted to a rotor of a power generator, or a power-generating device using a solar panel.

[11.5] Fifth Modification

Cases of a wristwatch and a standing clock were described above, but the present invention can also be widely applied to a digital timepiece that displays time by using display means other than pointers, a timepiece with a calendar mechanism, a radio-controlled timepiece that receives radio waves superimposed with a time code and corrects time on the basis of the time code, a GPS timepiece that receives a GPS signal and corrects the time, a pocket watch, a hanging clock, and other timepieces in general. The present invention can also be widely applied to mobile phones, PDAs (Personal Digital Assistants), portable measuring equipment, portable GPS (Global Positioning System) devices, and other portable electronic equipment comprising an operating module (which may or may not include a timepiece module) that operates based on the reference clock signal, as well as to standard oscillators, personal notebook computers, and other electronic equipment. The present invention can also be widely applied to electronic devices that can be driven by a commercial power source, and that comprise an operating module (which may or may not include a timepiece module) that operates based on the reference clock signal.

When applied to a radio-controlled timepiece in particular, a sufficiently accurate time can be displayed even when, for example, radio waves cannot be received in locations with poor reception (inside buildings, underground, in water, near a noise source), locations in which radio waves are not present (in space, locations without a standard time signal station, and the like), when antenna orientation is unsuitable, during periodic radio wave inspection, when the radio wave frequency and time code are different, when the electric field intensity is reduced due to meteorological conditions, or in other situations. A highly precise radio-controlled timepiece can be provided in such a variety of situations. When applied to mobile phones or other data communication equipment, highly reliable and rapid communication can be carried out by using the reference clock signal CLK0 from the atomic oscillator 13 as a reference signal that determines the communication bit rate.

The terms "front," "back", "up," "down," "perpendicular," "horizontal," "diagonal," and other direction-related terms used above indicate the directions in the diagrams used herein. Therefore, the direction-related terms used to describe the present invention should be interpreted in relative terms as applied to the diagrams used.

"Substantially," "essentially," "about," and other approximation-indicating terms used above represent a reasonable amount of deviation that does not bring about a considerable change as a result. Terms that represent these approximations should be interpreted so as to include an error of about ±5% at least, as long as there is no considerable change due to the deviation.

This specification incorporates by reference Japanese Patent Application Nos. 2005-211846, 2005-211940, 2006-182360, and 2006-182518 in their entirety.

The embodiments described above constitute some of the possible embodiments of the present invention, and it is apparent to those skilled in the art that it is possible to add modifications to the above-described embodiments by using the above-described disclosure without exceeding the range of the present invention as defined in the claims. The above-described embodiments furthermore do not limit the range of the present invention, which is defined by the accompanying claims or equivalents thereof, and are merely designed to provide a description of the present invention.

What is claimed is:

1. A portable timepiece, comprising:

an atomic oscillator configured to generate and output a reference clock signal, the atomic oscillator having an atomic oscillator unit and a control unit;

a timepiece module configured to operate based on the reference clock signal;

a power source configured to supply power to the atomic oscillator and the timepiece module;

a timepiece case configured to accommodate the atomic oscillator, the timepiece module, and the power source;

a thermal separator configured to separate thermally the atomic oscillator and the timepiece module, the atomic oscillator unit being embedded by the thermal separator, the atomic oscillator including a cell in which atoms are sealed, a heater for heating the cell, and a control device in which the point of reference is a frequency being equivalent to the energy difference between the energy level of the ground state and the energy level of the excited state by excitation of the atoms in the cell, the control device configured to control the heater and maintains the cell at a specific temperature.

2. The portable timepiece according to claim 1, wherein the atomic oscillator is placed in a position relative to the timepiece module and is integrated with the timepiece module.

3. The portable timepiece according to claim 1, wherein the timepiece case includes a case back, and the atomic oscillator is supported on the case back.

4. The portable timepiece according to claim 1, wherein the portable timepiece is a wristwatch that includes a timepiece band for mounting the portable timepiece on an arm.

5. The portable timepiece according to claim 1, further comprising a dial for displaying time, wherein the atomic oscillator is supported in the dial.

6. The portable timepiece according to claim 1, wherein the control circuit is embedded by the thermal separator.

7. The portable timepiece according to claim 1, further comprising a atomic oscillator case being antimagnetic, wherein the atomic oscillator is disposed in the atomic oscillator case, and either an air layer or a thermally insulating material is disposed between the atomic oscillator and the timepiece module as the thermal separator.

8. The portable timepiece according to claim 7, wherein the timepiece case has a module-accommodating part configured to accommodate the timepiece module, and the atomic oscillator is disposed around the periphery of the module-accommodating part.

9. The portable timepiece according to claim 8, further comprising a casing frame configured within the timepiece case, the casing frame configured to support the timepiece module and to be formed from a thermally insulating material that functions as the thermal separator, wherein the module-accommodating part accommodates the timepiece module supported by the casing frame.

10. The portable timepiece according to claim 1, wherein the atomic oscillator and the timepiece module are disposed to be separated in three dimensions.

11. The portable timepiece according to claim 10, wherein the timepiece module and the atomic oscillator are disposed so that orthogonal projections of the timepiece module and the atomic oscillator onto a specific plane do not overlap.

12. An electronic device, comprising:

an atomic oscillator configured to generate and to output a reference clock signal, the atomic oscillator having an atomic oscillator unit and a control unit;

an operating module configure to operate based on the reference clock signal;

a power source configured to supply power to the atomic oscillator and the operating module;

an electronic device case configured to accommodate the atomic oscillator, the operating module, and the power source;

a thermal separator configured to separate thermally the atomic oscillator and the operating module, the atomic oscillator unit being embedded by the thermal separator, the atomic oscillator including a cell in which atoms are sealed, a heater for heating the cell, and a control device in which the point of reference is a frequency being equivalent to the energy difference between the energy level of the ground state and the energy level of the excited state by excitation of the atoms in the cell, the control device configured to control the heater and maintains the cell at a specific temperature.

13. The electronic device according to claim 12, further comprising a atomic oscillator case being antimagnetic, wherein the atomic oscillator is disposed in the atomic oscillator case, and either an air layer or a thermally insulating material is disposed between the atomic oscillator and the timepiece module as the thermal separator.

14. An electronic device, comprising:

a crystal oscillator configured to generate and output a first oscillation signal;

an atomic oscillator configured to generate and output a second oscillation signal with a higher precision than the first oscillation signal, the atomic oscillator having an atomic oscillator unit and a control unit;

an operating module configured to operate based on the first oscillation signal and the second oscillation signal;

a power source configured to supply power to the atomic oscillator and the operating module;

a electronic device case configured to accommodate the atomic oscillator, the operating module, and the power source; and a thermal separator configured to separate thermally the atomic oscillator from the crystal oscillator and the operating module, the atomic oscillator unit being embedded by the thermal separator, the atomic oscillator including a cell in which atoms are sealed, a heater for heating the cell, and a control device in which the point of reference is a frequency being equivalent to the energy difference between the energy level of the ground state and the energy level of the excited state by excitation of the atoms in the cell, the control device configured to control the heater and maintains the cell at a specific temperature.

15. The electronic device according to claim 14, wherein the crystal oscillator and the operating module are disposed integrally with each other.

16. The electronic device according to claim 14, wherein the atomic oscillator is disposed integrally with the operating module.

17. The electronic device according to claim 14, wherein the thermal separator includes either an air layer or a thermally insulating material.

18. The electronic device according to claim 14, further comprising the electronic device case having a module-accommodating part for accommodating the operating module, wherein the atomic oscillator is disposed around the periphery of the module-accommodating part of the electronic device case.

19. The electronic device according to claim 18, further comprising a casing frame formed from a thermally insulating material that supports the operating module, wherein the module-accommodating part accommodates the operating module supported by the casing frame.

20. The electronic device according to claim 18, wherein the atomic oscillator and the operating module are disposed to be separated in three dimensions.

21. The electronic device according to claim 20, wherein the operating module and the atomic oscillator are disposed so that orthogonal projections of the operating module and the atomic oscillator onto a specific plane do not overlap.

22. The electronic device according to claim 14, wherein the electronic device constitutes a timekeeping device, and the operating module includes a timepiece drive circuit.

23. The electronic device according to claim 22, wherein the electronic device is a wristwatch, and the atomic oscillator is supported on a case back that constitutes the electronic device case.

24. The electronic device according to claim 22, wherein the electronic device is a wristwatch, the electronic device includes a timepiece band for mounting the wristwatch on a body, and the atomic oscillator is supported in the timepiece band.

25. The electronic device according to claim 22, further comprising a dial configured to display time, wherein the atomic oscillator is supported in the dial.

* * * * *